US006616456B1

(12) United States Patent
Nalty et al.

(10) Patent No.: US 6,616,456 B1
(45) Date of Patent: Sep. 9, 2003

(54) APPARATUS FOR PERFORMING HIPPOTHERAPY

(75) Inventors: Theresa J. Nalty, Kent, WA (US); Wayne Skloss, San Antonio, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 09/646,259

(22) PCT Filed: Mar. 10, 1999

(86) PCT No.: PCT/US99/05272

§ 371 (c)(1),
(2), (4) Date: Jul. 27, 2001

(87) PCT Pub. No.: WO99/46022

PCT Pub. Date: Sep. 16, 1999

Related U.S. Application Data

(60) Provisional application No. 60/077,580, filed on Mar. 10, 1998.

(51) Int. Cl.[7] ..... A63B 69/04

(52) U.S. Cl. ..... 434/247; 434/256; 472/59; 472/97

(58) Field of Search ..... 472/59, 60, 61, 472/130, 135, 136, 137; 434/55, 247, 256

(56) References Cited

U.S. PATENT DOCUMENTS

| | | | | |
|---|---|---|---|---|
| 2,473,649 A | | 6/1949 | Jensen | 272/73 |
| 2,738,199 A | | 3/1956 | Rand | 280/1.182 |
| 4,063,607 A | | 12/1977 | Patrick | 180/6.5 |
| 4,351,522 A | | 9/1982 | Marburger et al. | 272/52 |
| 4,566,688 A | | 1/1986 | Monica | 272/53.1 |
| 4,575,072 A | | 3/1986 | Russell | 272/52 |
| 4,690,397 A | | 9/1987 | Abed | 272/53.2 |
| 4,957,444 A | | 9/1990 | Armen | 434/247 |
| 4,988,300 A | * | 1/1991 | Yamaguchi et al. | 434/247 |
| 5,085,425 A | * | 2/1992 | Collins et al. | 472/97 |
| 5,180,338 A | * | 1/1993 | Pinto | 472/96 |
| 5,429,515 A | * | 7/1995 | Greenwood | 434/247 |
| 5,466,191 A | | 11/1995 | Chang | 472/95 |
| 5,569,167 A | | 10/1996 | Friedli | 601/23 |
| 5,580,315 A | | 12/1996 | Katz | 472/104 |
| 5,580,338 A | | 12/1996 | Scelta et al. | 482/62 |
| 5,848,939 A | | 12/1998 | Smith | 472/60 |
| 6,059,666 A | * | 5/2000 | Ohara et al. | 472/97 |
| 6,315,673 B1 | * | 11/2001 | Kopera et al. | 472/60 |

FOREIGN PATENT DOCUMENTS

WO PCT/US99/05272 3/1999 ..... A63G/13/06

OTHER PUBLICATIONS

Strauss, Ingrid. Hippotherapy: Neurophysiological Therapy on the Horse. Ontario Therapeutic Riding Association. Germany 1991. pp. 12–27, 32–37, 40–43, 46–51, 60–63, 72–75, 88–89, 92–93.

Bertoti, Delores B. "Effect of Therapeutic Horseback Riding on Posture in Children with Cerebral Palsy". Physical Therapy (Peer Reviewed Journal). vol. 68/No. 10, Oct. 1988. pp. 1505–1512.

Heipertz, Wolfgang et al. Therapeutic Riding: Medicine, Education, Sports. Greenbelt Riding Association for the Disabled (Ottowa) Inc. Germany 1977.

* cited by examiner

*Primary Examiner*—Kien T. Nguyen
(74) *Attorney, Agent, or Firm*—Trop, Pruner & Hu, P.C.

(57) ABSTRACT

A therapeutic riding device which treats physical and mental impairments of riders by simulating the motion of a horse in three dimensions. A patient sits on a seat (12) which is mechanically driven by a motor (13) and an arrangement of members having cams (33*a*, 33*b*). The three-dimensional pattern made by the seat may be controlled so as to mimic an ideal hippotherapy horse.

30 Claims, 17 Drawing Sheets

APPARATUS FOR PERFORMING HIPPOTHERAPY

This application claims the benefit of provisional application No. 60/077,580 filed Mar. 10, 1998.

TECHNICAL FIELD

The present invention relates to riding devices, and more particularly to a therapeutic riding device which treats physical and mental impairments of riders by simulating the motion of a horse in three dimensions.

BACKGROUND OF THE INVENTION

Hippotherapy is the use of horseback riding to enhance the balance and muscle function of people with neurological disorders. This technique originated in Germany and has been used in the United States since the 1950's. In the United States licensed physical and occupational therapists have designed hippotherapy treatments for over 26,000 neurologically impaired riders.

Physical therapists have documented the following medical benefits of hippotherapy: decreased spasticity, improved balance, improved coordination, improved gait, improved posture, and improved range of motion. Occupational therapists have reported that hippotherapy improves the organization of the sensory system, increases oral motor control, improves cognition, awareness, and processing, improves hand control, and increases the psycho-social interaction of the rider with the environment.

Unfortunately the cost of boarding, feeding, training, grooming, and caring for a horse for use in hippotherapy has prevented many therapists from utilizing this therapeutic exercise. In fact, due to the lack of a cost-effective hippotherapy treatment method, in conjunction with dwindling insurance reimbursements, many therapy centers simply can not afford to implement a hippotherapy program.

The use of a horse in hippotherapy has several inherent limitations. For example, it is difficult to select and train a horse for hippotherapy. Only about 15% of the available horses in the United States fit the criteria for the proper pelvic, trunk, hip, and leg movements during walking to be of therapeutic value to the rider. If a suitable horse can be found, it must then be trained to accommodate a physically or neurologically impaired rider. This includes desensitization of the horse to the sights and sounds associated with moving wheelchair components, unusual vocalizations or limb movements from the rider, stiff legs and trunk of the rider, an inability of the neurologically impaired rider to shift his/her weight when necessary, and the many volunteers walking beside the horse and possibly holding the rider. Once a horse is selected, most often that horse is kept in a horse arena which may be out-of-town. Having to travel to perform hippotherapy is inconvenient for the caregiver or parent of a neurologically impaired rider. If more than one horse is used for hippotherapy, the anatomical and biomechanical variations between the horses may prevent riders from experiencing the same level of therapy from one treatment session to another.

Often, hippotherapy is limited by weather conditions and the mood of the horse. Rain, lightning, or high winds can startle a horse, requiring immediate dismount of the rider and cessation of the hippotherapy treatment. Also, horses may become agitated from seemingly insignificant incidents such as a piece of paper blowing across the dirt, other horses walking into the arena, sudden movements, or loud noises. In order to prevent a horse from bolting out of an arena with the mounted rider or rearing up onto its hind legs throwing the rider off the saddle, a person leading the horse often needs to tightly control the reins while standing in front of the horse.

Other problems associated with hippotherapy arise due to the condition of the rider. Neurologically-impaired riders often require three to four people at the horse arena to (a) determine the most therapeutic position for the rider receiving hippotherapy, (b) groom and saddle the horse, (c) assist in the transfer to and from the horse, and (d) lead or walk beside the horse. In the event that one or more of these people are absent, the rider often can not safely receive hippotherapy, so treatment must be canceled. Physically or psychologically impaired riders sometimes have weak or no strength in their hands which prevents the riders from forming a good grip onto the horn of a horse's saddle. Furthermore, riders often have poor balance and coordination. Additionally, it is often difficult for riders to regain control of a startled horse, even if assisted by a therapist. Because some neurologically impaired riders require additional physical support during hippotherapy, an adult often sits on the same horse and holds the patient from behind. This technique, however, puts extra strain on the back of the horse which can cause it injury. If a horse's back has been injured, no riding will be allowed until the injury has healed.

Finally, hippotherapy carries with it the risk of injury to the rider or to therapists assisting the rider. Therapists may be stepped on or kicked by the horse. Riders may fall off a startled horse, incurring serious injury despite the use of a helmet.

The problems enumerated in the foregoing are not intended to be exhaustive but rather are among many which tend to impair the effectiveness of previously known hippotherapy treatments. Other noteworthy problems may also exist: however, those presented above should be sufficient to demonstrate that hippotherapy treatment in the art has not been altogether satisfactory.

SUMMARY OF THE INVENTION

Biomechanical analyses of the three planes of movement which occur as horses walk have provided much information on pelvic movements of an ideal hippotherapy horse. It has been determined that an ideal hippotherapy horse has a walking pace of 60–120 steps per minute. Such a pace is believed to provide for maximum therapeutic value for a rider patient. Analyses of the effects imposed on the rider currently indicate that three dimensional cyclic movement patterns of the horse's pelvis should be within the following parameters: a lateral pelvic tilt of about 5° to about 15°, with a preferred lateral pelvic tilt of about 10°. This value was determined by drawing an imaginary line in the y-direction through the posterior aspect of the ileum bone comprising half of the pelvis. As the horse completed push-off and began the swing phase of the hind limb forward, that half of the pelvis tilted out (laterally). A second imaginary line was drawn through the same points on the posterior aspect of the ileum. The angle between these two lines during rotation of the ileum along the z-axis was determined to be about 5° to about 15° and was called the lateral pelvic tilt.

During limb acceleration (swing phase) the horse's trunk and pelvis were rotated forward about 3° to about 15°, with an average rotation of about 5° to about 8° (with the spine as the origin of the angle). Similarly, deceleration of the limb in the stance phase caused rotation of that side of the pelvis in the opposite direction. Schematic representation of this motion can be described as a rotation about the local z-axis at the left pelvis (point B of FIG. 1) of the horse. A clockwise rotation about the z-axis, viewed from above the horse, would result in a pelvic rotation forward. The same clockwise rotation along the local z-axis at the right pelvis (point A of FIG. 1) would result in a pelvic rotation back toward the tail of the horse.

Coupled with the pelvic rotation is a lateral displacement along the x-axis of about 3 cm to about 12 cm. Ideally, 7–8 cm of lateral pelvic displacement would occur. Note that lateral pelvic displacement occurs in the positive x-direction on the left side and in the negative x-direction on the right side of the body. The lateral pelvic displacement was measured at the greatest point of the arc along the local x-axis and was directly related to the size of the pelvis of the horse.

A displacement occurs along the z-axis as the horse loads and then unloads the hind limb. This measurement was recorded by measuring the change in the height of the pelvis from the neutral line between point A and point B (FIG. 1) and (FIG. 16). Depending on the height of the horse, this displacement on the average horse was found to be about 2 cm to about 10 cm, with a preferred value of about 5 cm.

In addition, the horseback rider experiences a cyclic rise and fall of one side of the saddle as the horse's pelvis tilts up and down in the xy plane. During the swing phase of the right hind limb, the right side of the pelvis undergoes a posterior pelvic tilt (tilts up to allow clearance of the limb). After hoof strike, the limb is decelerating and is aided by an anterior tilt of the horse's pelvis on that side. This causes the iliac crest to drop downward toward the ground, weighting the limb for greater deceleration. This movement corresponds to a rotation along the local x-axis (FIG. 1 and FIG. 7). Looking toward the x-axis of rotation (left to right), a counterclockwise rotation of the local x-axis corresponds to an anterior tilt of the horse's pelvis with a lowering of the rider (FIG. 1 and FIG. 2). The anterior tilt occurs in a range of about 2° to about 15°, with a preferred anterior tilt of about 3° to about 10°. Similarly a posterior tilt corresponds to a clockwise rotation along the local x-axis and could occur in the range of about 2° to about 25°, with a preferred posterior tilt of about 3° to about 7° (FIG. 7).

A therapeutic riding apparatus for simulating three dimensional motion of a horse, in accord with the invention, comprises a split seat with two independent axes of rotation and a plurality of members mechanically coupled to the split seat. The seat is covered with a thick cushioned surface capable of transmitting the three dimensional movements generated from two local axes. The plurality of members drive the split seat in a three dimensional pattern which mimics the three dimensional motion of the torso of the horse upon which the rider is seated.

In accord with one aspect of the invention, the three dimensional pattern includes simulating the number of horse steps per minute, with about 20 to about 200 horse steps per minute being preferred, and about 60 to about 120 simulated horse steps per minute being more preferred. Further, the three dimensional pattern simulates the horse's cyclic lateral pelvic tilt of approximately ten degrees. Even further, the three dimensional pattern simulates the horse's cyclic pelvic rotation of about five degrees to about eight degrees with a corresponding lateral pelvic displacement along the x-axis of about seven to eight centimeters. In addition, the three dimensional pattern on each side simulates an upward displacement along the z-axis of about 5 centimeters from the neutral line and a downward displacement along the z-axis to about 5 centimeters below the neutral line for a total excursion of about 10 centimeters. Yet further, the three dimensional pattern simulates the cyclic anterior or posterior tilt of three to ten degrees.

An apparatus for performing hippotherapy, in accord with another aspect of the invention, includes a cushioned split seat configured to support one or two adult riders. Two outer cams are coupled to the seat and are configured to propel the seat in a first set of directions. Two inner cams are coupled to the seat and are configured to propel the seat in a second set of directions. Two innermost cams are coupled to a linkage system to propel the seat in a third set of directions.

In accord with yet another aspect of the invention, the cam pairs are machined to simulate movement in each of three dimensions. The cams in each pair are positioned 180° to each other in order to create an alternating movement pattern of the left and right sides of the split seat corresponding to an alternating pattern of a horse's gait.

In accord with another aspect of the invention, the cam pairs may be substituted for other cam pairs having different eccentricities or other such attributes to change a movement pattern of the seat.

In accord with another aspect of the invention, the degree of movement of each cam pair is not dependent on the other two cam pairs, such that a cam pair could be substituted to provide little to no movement in one dimension without altering the remaining two dimensions of movement.

A riding device, in accord with an alternate embodiment of the invention, includes a cushioned split seat adapted to support one or two adults. Two or more members are configured to drive each half of the seat in two separate three dimensional cyclic patterns that mimic the two movement patterns of the left and right side of a horse in motion.

A hippotherapy device, in accord with another embodiment of the invention, may include a cushioned split seat. An outer member is mechanically coupled to the split seat and is adapted to move one side of the seat forwards and backwards (rotation about the local z-axis). This member is designed in such a way that there is a corresponding opposite and equal movement on the other side. This results in an arc of motion consisting of a lateral pelvic displacement (along the local x-axis). An inner cam set rotates along the local x-axis, but due to its design results in an upward or downward movement of the seat (displacement along the local z-axis). An innermost cam set, when rotated along the local x-axis is kept in contact with the cam follower through tension provided by a spring. The preferred embodiment is a closed track cam system, in which no spring is needed. As the cam follower moves, the angle of a linkage mechanism is increased or decreased, affecting the angle of the seat. When the seat is tipped downward, it corresponds to the anterior tilt of the horse's pelvis. Similarly, when the seat is tipped upward, it simulates the posterior tilt of the horse's pelvis during gait. The left and the right cams for each cam pair are custom machined and positioned at 180° to each other. In addition, the corresponding member is positioned such that the rotation along each local axes will be equal and opposite corresponding with the movements of the left and right sides of a walking horse. A driving shaft is rotated by a rotational force and is coupled to the outer. inner, and innermost cam pairs and is configured to drive the outer, inner, and innermost members. In a typical embodiment, a motor provides the rotational force.

An apparatus for treating physical and mental impairments of a patient by simulating the motion of a horse, in accord with the invention, may include a cushioned split seat for supporting the patient and if necessary, the therapist. A pair of outer cams is coupled to the seat. A pair of inner cams is coupled to the seat. A pair of innermost cams is coupled to the seat. A motor is coupled to the pair of outer cams and to the pair of inner cams and to the pair of innermost cams. As used herein, the term "motor" refers to an electric, hydraulic, or any other rotational force generator. In preferred embodiments, the motor is an electrical motor. Some advantages of an electric motor include its lightness in weight relative to other motors, relative low cost, potential to utilize batteries in portable situations, and ease of use. Other types of motors may, however, be suitable for manipulating the present invention. For example, it is envisioned that a hydraulic power unit (which may be controlled by an electric motor) driving a hydraulic pump may offer certain advantages in control and manipulation of the speed of the cycles. Similarly, a hydraulic pump could provide power for double acting hydraulic cylinders. Similarly, a pneumatic pump powering a pneumatic motor may also be used to power the present apparatus, depending on a particular application. It is also recognized that the present invention may be controlled by microprocessors, which may offer advantages in manipulating the three dimensional mover, heating pad, or any other elements or added features of the invention. Furthermore, it is envisioned that the movements described in the present disclosure could be controlled by a linear or rotary servo mechanism consisting of a computer numerically controlled unit or other forms of microprocessors with electromechanical actuators, encoders, and tachometers and still be within the scope and spirit of this invention. Advantages to the servo mechanism include the ability to progress the patient to a more challenging degree of motion without exchanging the cams. The servo mechanism would provide an infinite level of control over the degree of motions.

These and other objects, features, and advantages of the invention will be further described and more readily apparent from a review of the detailed description of typical embodiments which follows.

BRIEF DESCRIPTION OF THE DRAWINGS

FIG. 7 illustrates Z-Displacements of points C and D.

FIG. 8 illustrates the terminal stance position of a horse: C:Rotation X, clockwise (CW) 2° from position of FIG. 15, (4° below neutral); D: Rotation X, counter clockwise (CCW) 10° from position FIG. 15, (3° below neutral).

FIG. 9 illustrates the push-off position of a horse: C:Rotation X, counter clockwise (CCW) 6° from position of FIG. 8, (10° below neutral); D: Rotation X, clockwise (CW) 2° from position of FIG. 8, (1° below neutral).

FIG. 10 illustrates mid-swing position of a horse: C:Rotation X, clockwise (CW) 14° from position of FIG. 9, (4° above neutral); D: Rotation X, counter clockwise (CCW) 1° from position of FIG. 9, (2° below neutral).

FIG. 11 illustrates terminal swing position of a horse: C:Rotation X, clockwise (CW) 3° from position of FIG. 10, (7° above neutral); D: Rotation X, counter clockwise (CCW) 4° from position of FIG. 10, (6° below neutral).

FIG. 12 illustrates hoof strike position of a horse: C:Rotation X, counter clockwise (CCW) 10° from position of FIG. 11, (3° below neutral); D: Rotation X, clockwise (CW) 2° from position of FIG. 11, (4° below neutral).

FIG. 13 illustrates initial stance position of a horse: C:Rotation X, clockwise (CW) 2° from position of FIG. 12, (1° below neutral); D: Rotation X, counter clockwise (CCW) 6° from position of FIG. 12, (10° below neutral).

FIG. 14 illustrates mid stance position of a horse: C:Rotation X, counter clockwise (CCW) 1° from position of FIG. 13, (2° below neutral); D: Rotation X, clockwise (CW) 14° from position FIG. 13, (4° above neutral).

FIG. 15 illustrates late stance position of a horse: C:Rotation X, counter clockwise (CCW) 4° from position of FIG. 14, (6° below neutral); D: Rotation X, clockwise (CW) 3° from position of FIG. 14, (7° above neutral).

FIG. 16 illustrates Z-Displacements of Points A & B. The distance between points A and B is equal to 45 cm minimum, 70 cm maximum.

FIG. 17 illustrates the terminal stance position of a horse: A: −6 cm from position of FIG. 24 (5 cm below neutral; B: −2 cm from position of FIG. 24 (5 cm below neutral).

FIG. 18 illustrates the push-off position of a horse: A: 2 cm from position of FIG. 17 (3 cm below neutral; B: 4 cm from position of FIG. 17 (1 cm below neutral).

FIG. 19 illustrates the mid swing position of a horse: A: 8 cm from position of FIG. 18 (5 cm above neutral; B: 4 cm from position of FIG. 18 (3 cm above neutral).

FIG. 20 illustrates terminal swing position of a horse: A: −8 cm from position of FIG. 19 (3 cm below neutral; B: −2 cm from position of FIG. 19 (1 cm above neutral).

FIG. 21 illustrates the hoof strike position of a horse: A: −2 cm from position of FIG. 20 (5 cm below neutral; B: −6 cm from position of FIG. 20 (5 cm below neutral).

FIG. 22 illustrates the initial stance position of a horse: A: 4 cm from position of FIG. 21 (1 cm below neutral; B: 2 cm from position of FIG. 21 (3 cm below neutral).

FIG. 23 illustrates the mid stance position of a horse: A: 4 cm from position of FIG. 22 (3 cm above neutral; B: 8 cm from position of FIG. 22 (5 cm above neutral).

FIG. 24 illustrates the late stance position of a horse: A: −2 cm from position of FIG. 23 (1 cm above neutral; B: −8 cm from position of FIG. 23 (3 cm below neutral).

FIG. 25 illustrates the terminal stance of a horse: A: 2° rotation, CW (8° from neutral); B: 2° rotation, CW (8° from neutral).

FIG. 26 illustrates the push-off position of a horse: A: No change; B: 2° rotation, CCW (6° from neutral).

FIG. 27 illustrates the mid-swing position of a horse: A: 7° rotation, CCW (1° from neutral); B: 8° rotation, CCW (2° from neutral).

FIG. 28 illustrates the terminal swing position of a horse: A: 7° rotation, CCW (6° from neutral); B: 4° rotation, CCW (6° from neutral).

FIG. 29 illustrates the hoof strike position of a horse: A: 2° rotation, CCW (8° from neutral); B: 2° rotation, CCW (8° from neutral).

FIG. 30 illustrates the initial stance position of a horse: A: 2° rotation, CW (6° from neutral); B: No change (8° from neutral)

FIG. 31 illustrates the mid stance position of a horse: A: 8° rotation, CW (2° from neutral); B: 7° rotation, CW (1° from neutral).

FIG. 32 illustrates the late stance position of a horse: A: 4° rotation, CW (6° from neutral); B: 7° rotation, CW (6° from neutral).

FIG. 35A shows upper trunk and upper extremity strengthening, FIG. 35B shows alternating leg swing in sitting, FIG. 35C shows trunk rotation with upper extremities moving in functional diagonal patterns. FIG. 35D shows back, hip, and shoulder muscle strengthening, FIG. 35E shows continuous passive three dimensional motion at the wrist and shoulder in a weight bearing position, FIG. 35F shows vaulting exercises to progress to standing on the dynamic surface.

DETAILED DESCRIPTION OF ILLUSTRATIVE EMBODIMENTS

Figure 1:
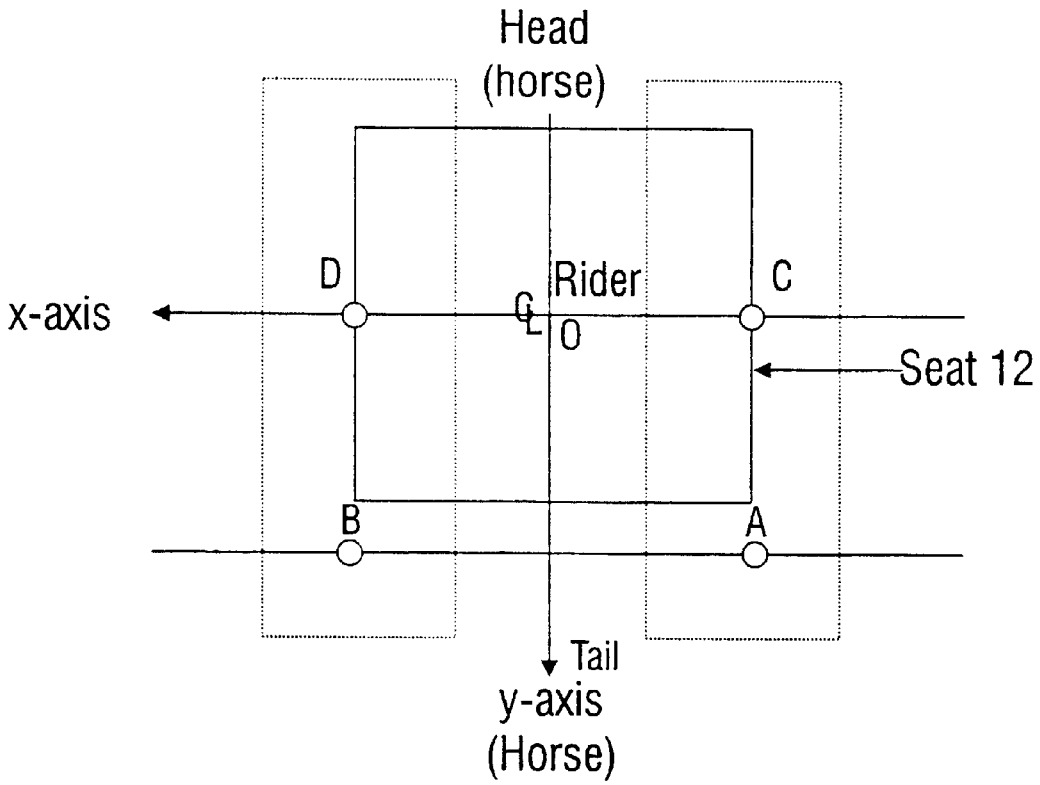
FIG. 1, is a schematic representation of the local axes of rotation about points A, B, C or D corresponding to the horse's pelvis and the relative position of the rider.

In the drawings, depicted elements are not necessarily drawn to scale and like or similar elements may be designed by the same reference numeral throughout the several views. The actual contour and surface of the cams are only schematically illustrated.

FIG. 1 illustrates the direction of the y-axis from the head to the tail of the horse as well as the direction of the x-axis from the right to the left side of the horse. The same orientation is used to describe the three dimensional mover of the present invention. In a typical embodiment, the dimensions for the seat 12 (which, in an exemplary embodiment may be a split seat) upon which the rider sits is illustrated schematically as about 80 cm in length with a minimum width of about 30 cm and a maximum width of about 70 cm. The dotted box around points B/D and A/C depict the independent motions of the left and right side of the device and not the split seat. Also shown is the location of the local x-axis of rotation located about 70 cm from the center line of the rider at point A or B. Implied is the location of the local y-axis of rotation located about 24.5 cm to about 35 cm from the center line of the rider at point A or B. It is recognized that these dimensions are approximate, and are for illustrative purposes to show various aspects of the invention. It is recognized that other dimensions may be used and still be within the scope and spirit of the invention.

Figure 2:
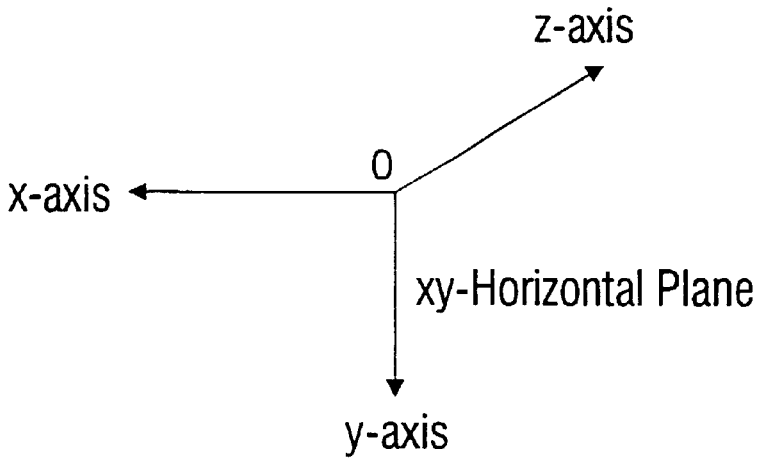
FIG. 2 illustrates the coordinate system for the horse and three dimensional mover in accordance with the present disclosure.

FIG. 2 shows all three axes of the coordinate system. The direction of the z-axis passes vertically from the belly of the horse to the back or riding surface of the horse. The same direction and orientation of the axes will be used when describing the three dimensional mover.

Figure 3:
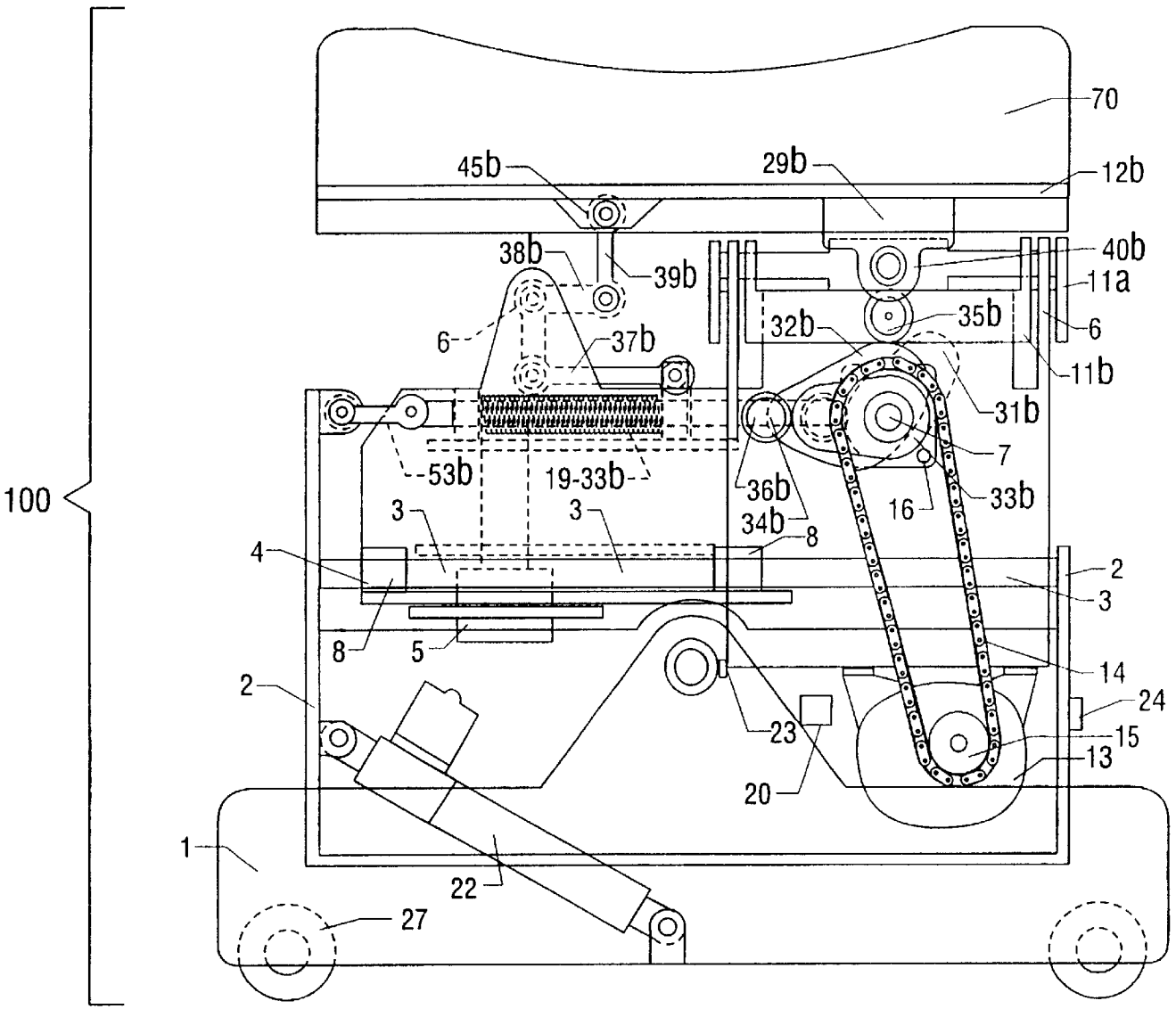
FIG. 3 is a side view of a three dimensional mover from the left in accordance with the present disclosure. The platform 1 for tilt mechanism 22 is not drawn to scale. The size and shape of the cams are schematically drawn.

FIG. 3 illustrates a side view of a most typical embodiment 100. In this side view, reference numerals are shown with a "b" to indicate that the element is a left side element. However, the specification refers generally to elements without reference to "a" or "b." As shown in FIG. 3, the seat 12 (as shown in FIG. 3, seat 12 is a split seat having portions 12*a* (not shown in FIG. 3) and 12*b*) of the three dimensional mover 100 is located about 96.5 cm to about 115 cm from the ground and may support a weight of approximately 350 pounds (159 kg). It is recognized that these dimensions are approximate, and are for illustrative purposes to show various aspects of the invention. It is recognized that other dimensions may be used and still be within the scope and spirit of the invention.

An impaired rider sits on surface 70 (schematically illustrated in FIG. 33, FIG. 34*a*, FIG. 35*b*, and FIG. 35*c*), which is adapted on seat 12. Seat 12 may be constructed from sheet-metal, wood, plastic, or any other suitable material or combination thereof Seat 12 is designed so that the surface is split along the y-axis to allow independent three dimensional movement of the left versus the right sides. Seat 12 is designed so that different width platforms and cushioned surfaces 70 can be added. Alternatively, different types of saddles may be used to increase the width of the riding surface. In a most typical embodiment, the exchangeable platforms come in a selection range with about 1.91 cm (¾ inch) increments. In other embodiments, the range of exchangeable platforms for use over seat 12 may be in increments of about 0.64 cm (¼ inch), about 1.27 cm (½ inch), or about 2.54 cm (one inch) or other more commonly used metric increments. Each exchangeable platform can be covered with a surface 70. The exchangeable platform widths for use over seat 12 allow riders of different sizes, or those with limited range of hip motion, or restricted hip/pelvic muscle length to sit comfortably upon three dimensional mover 100. In a most typical embodiment, seat 12 is long enough to accommodate two adults (schematically illustrated in FIG. 33). It is often important for a therapist to ride behind a client and to assist directly with balance exercises. With the use of a horse, this practice is limited to small children due to the weight restrictions of the horse's back. In addition, it is difficult and unsafe for an adult to "backride" a client whose head is above the level of the therapist's chin, impairing the visual field of the therapist.

In a most typical embodiment, surface 70 will have a heated surface. Heating may be accomplished by incorporating a suitable heating element (not shown) in, on, or near surface 70. The warmth of surface 70 creates a feeling of bareback riding by simulating the physiological temperature of a horse. It has been suggested that such warmth may improve the abnormal muscle tone of the rider, leading to increased coordination, range of motion, function, and balance. The outer surface of seat 12 may be cushioned with any flexible material comprising surface 70, including, but not limited to foam, pockets of gel, pockets of air, pockets of fluid and then covered with any number of different types of materials, including, but not limited to, leather, vinyl, plastic, or cloth.

FIG. 3 also shows a tilt mechanism 22. Tilt mechanism 22 inclines the entire three dimensional mover to simulate the therapeutic riding technique of a horse walking up or down a hill. In a most typical embodiment, tilt mechanism 22 is constructed of an AC linear actuator, a 115 Volt AC limit switch with automatic brake-set ball brake, a 12 Volt DC motor, an overtravel protector, a load limiting friction disc clutch, and an automatic spring brake. An inclinometer is associated with tilt mechanism 22, inclinometer 23 measuring the tilt of three dimensional mover 100. In a most typical embodiment, inclinometer 23 is an ACCUSTAR™ electronic inclinometer that interfaces with a digital readout located on three dimensional mover 100. In that most typical embodiment, inclinometer 23 has a resolution of about 0.001° and a range of ±about 60°. In certain embodiments, inclinometer 23 may have a digital readout located on a hand held control device, such as the hand held device 21 of FIG. 6.

Also illustrated in FIG. 3 is a safety switch 24. When depressed, safety switch 24 shuts off power to the three dimensional mover, stopping its operation almost instantly. Such a switch provides therapists with an effective, quick means for removing impaired patients from the riding device in the case of an emergency or any other situation in which the machine needs to be turned off quickly. In a most typical embodiment, an additional safety switch 25 is located on a hand held device, such as hand held device 21 of FIG. 6. The convenient location of safety switch 25 allows a caregiver, even if she cannot reach safety switch 24, to quickly shut off the power to three dimensional mover 100.

Further illustrated in FIG. 3 is platform 1 that supports tilt mechanism 22. Platform 1 (not to scale) may be constructed of any suitable material capable of supporting the therapeutic riding device. In a most typical embodiment, wheels 27 are attached to the underside of platform 1. Wheels 27 may be caster wheels or any other suitable type of wheels. Wheels 27 may have individual locks that may be engaged when the therapeutic riding device is in operation. Such locks control or prevent unwanted sliding of the platform 1 supporting the three dimensional mover when the apparatus is in operation. When wheels 27 are not locked, caregivers can move the three dimensional mover to a convenient location. Additionally, wheels 27 allow a caregiver to roll the therapeutic riding device while it is in operation. For example, a caregiver might choose to roll the three dimensional mover in a FIG. 8 pattern while in operation to further challenge the balance of a rider. Attached to platform 1 is speed control mechanism 20. Speed control mechanism 20 is in operative relation to a power source of the three dimensional mover and controls the speed of operation of the therapeutic riding device. In a most typical embodiment, a varistat for controlling the simulated number of steps per minute of the three dimensional mover is located on a hand held control device, such as hand held device 21 of FIG. 6.

Figure 5:
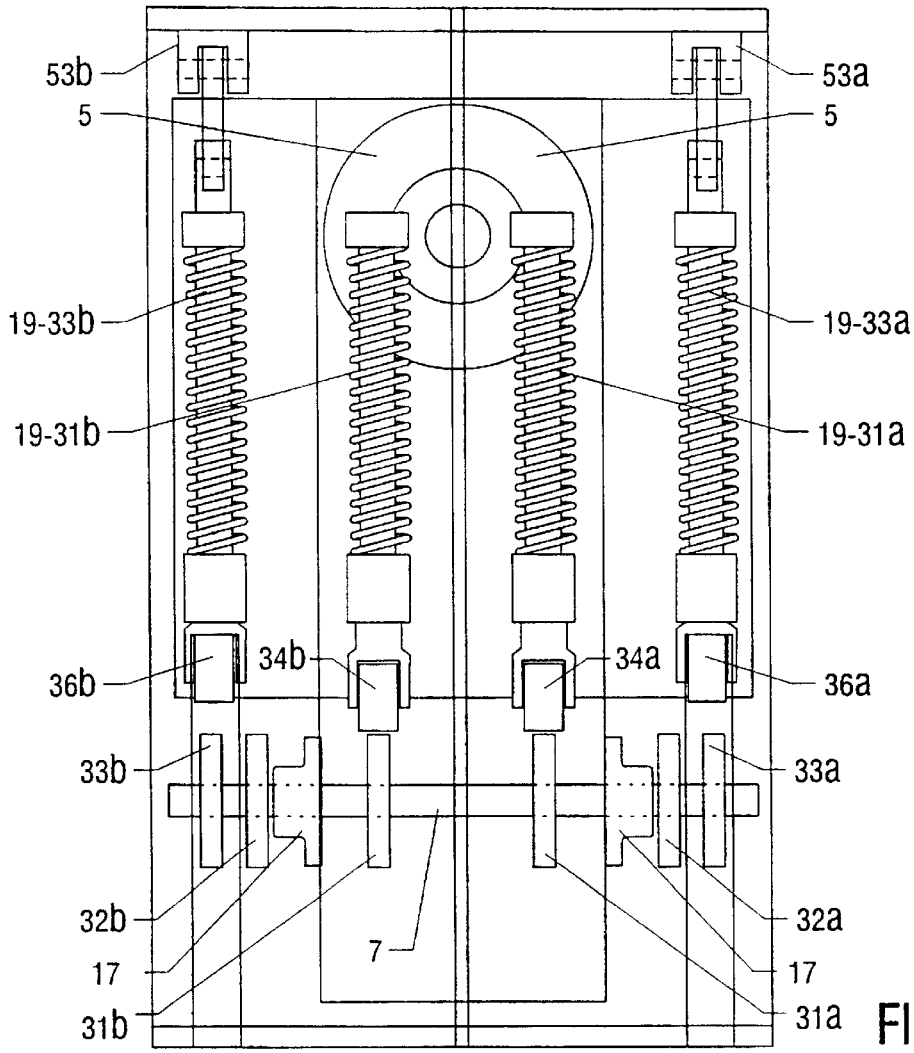
FIG. 5 is a top view of a three dimensional mover in accordance with the present disclosure. The size and shape of the cams are schematically drawn.

FIG. 3 also illustrates main support frame 2. Main support frame 2 supports shaft 3, which supports linear bearings 8. In a most typical embodiment, main support frame 2 is constructed of steel. Alternatively, main support frame 2 may be made of any suitable material capable of support. Shaft 3 is coupled to linear bearings 8. Four springs 19 provide the tension needed to keep the cams 31 and 33 against their respective cam followers (FIG. 3 and FIG. 5). When cam 31 rotates, spring 19 provides tension to keep cam follower 34 in close contact. When linkages 37 and 38 displace link 39, bracket 45 is displaced. The displacement of bracket 45 along the z-axis causes a tilt of seat 12. The preferred embodiment for this invention is a closed track cam system, negating the need for spring 19.

Figure 4:
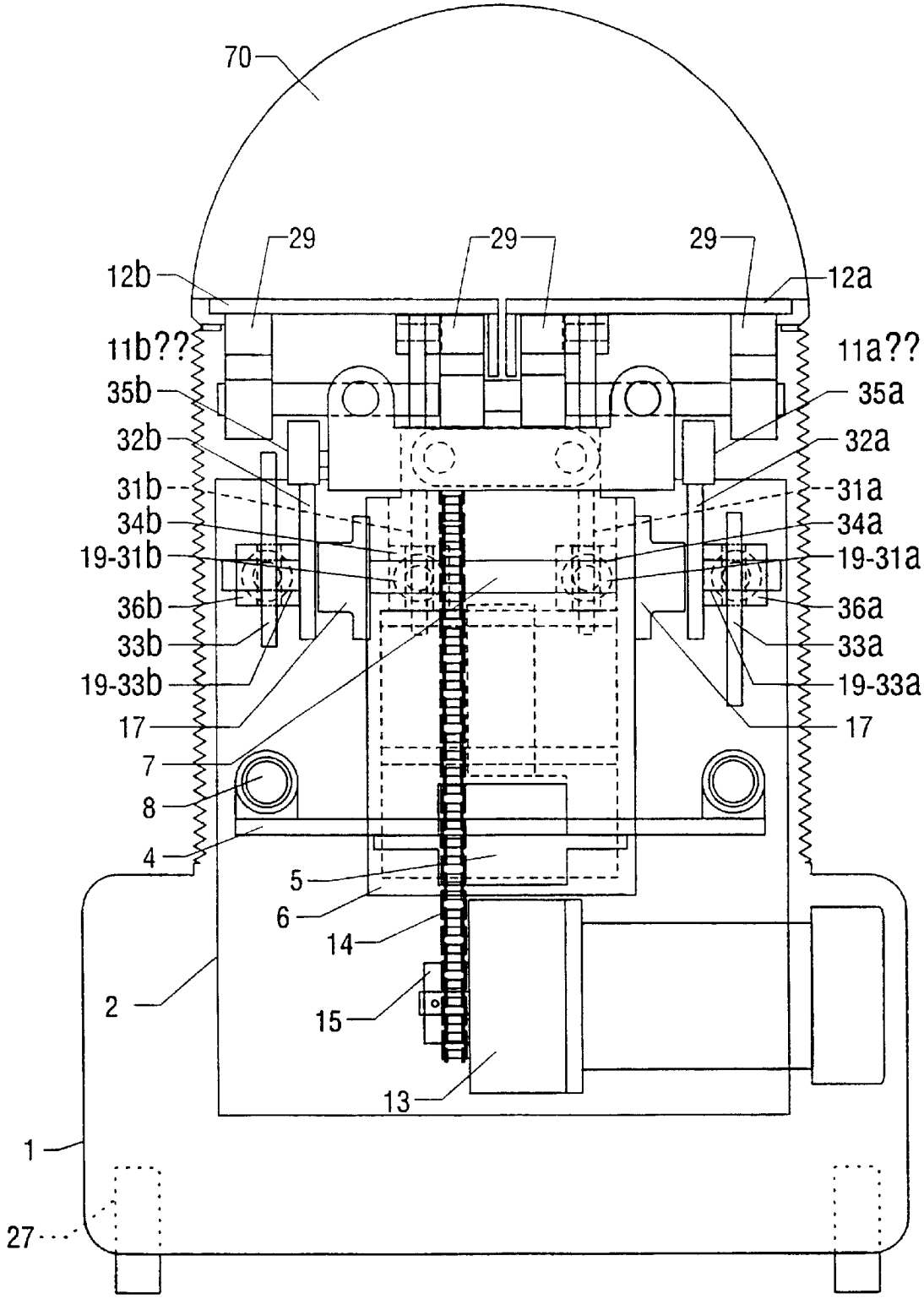
FIG. 4 is a rear view of a three dimensional mover in accordance with the present disclosure. The platform 1 for tilt mechanism 22 is not drawn to scale. The size and shape of the cams are schematically drawn.

Depicted in FIG. 4 is a rear view of three dimensional mover 100 according to the present disclosure. A motor 13 powers the hippotherapy/therapeutic riding device. In a most typical embodiment, motor 13 may be about 1.0 to about 5.0 horsepower, continuous-duty, DC motor that can achieve about 1725 rotations per minute. It is recognized that these motor parameters are for illustrative purposes, and that other rotations, powers, or gearing systems may be employed within the scope and spirit of the invention. Attached to motor 13 is a timing belt or chain 14. Timing belt or chain 14 is mounted upon a sprocket 15 that is attached to motor 13. Timing belt or chain 14 is also mounted upon a sprocket 16. Sprocket 16 is attached to a main shaft 7. Main shaft 7 is supported by ball bearings 17. An accordion-style rubber billows 71 over a thin metal plate covers the mechanical aspect of the machine from seat 12 to base 1. The billows 71 allow flexibility of the device during three dimensional movement.

Mechanically coupled to main shaft 7 is at least one cam. Schematically illustrated in the present embodiment are six cams. The actual diameter and contour of the cam surface is not shown. Each cam may be customized to meet the specifications described in FIG. 7 through FIG. 32. The cams are designed to drive the typical embodiment of the disclosed hippotherapy/therapeutic riding device in a three dimensional pattern. Specifically, the cams simulate the motion of the left and right legs of a horse. Each cam pair (for the left and right side) is custom designed and positioned to simulate the motion along one of the three axes of rotation. Since each axes of rotation provides distinctly different degrees and sequences of motion, the three cam sets are of different designs. In addition, the cams within each pair are positioned at 180° of each other to simulate the left and right side of the horse. Furthermore, each cam set pertaining to one of three dimensions of movement can be customized in a wide range of shapes and sizes. Since the three cam sets operate independently on one another, the degree of motion along one or more axes of rotation can be manipulated without altering the degree of motion provided along the other axes of rotation. It is recognized that one may desire to operate the three dimensional mover with a single cam, a plurality of cams, drives, cam plates, linkages, microprocessors or other means to simulate various three dimensional movements and still practice the present invention.

Outer cam **33*b* (on the left side) rotates along the x-axis. The cam follower 36*b* is kept against the cam with the aid of tension provided by spring 19–33*b*. The preferred embodiment for this invention utilizes a closed track cam system to keep the cam follower against the cam. Movement of linkage 53*b* results in a rotation of the seat forward about the local z-axis. There is a corresponding displacement of seat 12 in the y-direction (FIG. 2 shows the coordinate system). Looking toward the local z-axis (down onto the seat), clockwise rotation of point B (on the left) results in a negative y-displacement of point B. This results in a forward rotation of seat 12*b*, but does not directly affect the position of point A. It should be noted that clockwise rotation of point A along the local z-axis results in displacement of point A in a positive y-direction. The specifications of this movement are described in detail in FIG. 25 through FIG. 32**.

Cam follower 35*a* traces the rotation of inner cam 32*a* to produce an upward and downward movement of seat 12*a*. This displacement along the z-axis is achieved through rotation of the cam about the local x-axis. FIG. 16 through FIG. 24 provide the displacements and corresponding rotation of a typical embodiment. It is understood that the shape of the cam affects the amount of displacement. In a typical embodiment, displacement from neutral to about 0 cm to about 5 cm can be achieved with varying sizes and shapes of the cam.

Innermost cam 31 rotates on the local x-axis. Spring 19 provides the tension to keep the cam follower 34 in close contact with the cam. A closed track cam system is the preferred embodiment for this invention, negating the need for spring 19. When linkages 37 and 38 displace link 39, bracket 45 is displaced in a negative z-direction, causing seat 12 to tilt upward (posterior tilt). This corresponds to a clockwise rotation of cam 31 on the left side at point B (looking toward the x-axis direction; i.e., left to right). FIG. 7 through FIG. 15 provide the specifications regarding the degree of rotation about the local x-axis at points A and B. It is understood that the degree of rotation about the local x-axis can be altered through the shape or size of cam 31, directly affecting the anterior (downward) or posterior (upward) tilt, i.e.; z-displacement of seat 12 and still be within the scope and spirit of this invention.

Outer cams 33 rotate against cam followers 36. In a most typical embodiment, cams rotate on cam bearings constructed of steel ball bearings. Other suitable materials known in the art may alternatively be used for cam bearings. Inner cams 32 rotate against cam followers 35. In a most typical embodiment, cams rotate on cam bearings constructed of steel ball bearings. Other suitable materials known in the art may alternatively be used for cam followers 35.

As the action of the cams rotate seat 12 forward and backward in partial simulation of a horse's movements, seat 12 is supported by the mechanism of frame 6. Linear bearings 8 are coupled to a linear bearing base plate 4. Linear bearings 8 provide movement along the y-axis in response to rotation of the outer cams. Linear bearing base plate 4 supports bearing hub 5 for rotation. Bearing hub 5 provides rotation on the z-axis and is coupled to a subframe 6. Subframe 6 supports arms 11. Subframe 6 may be made of any material suitable for support arms 11. In a most typical embodiment, subframe 6 is constructed of about 2.54 cm (1 inch) solid round steel. Arms 11 may similarly be constructed from any suitable material, including, but not limited to plastic, wood, metal, titanium or any alloy combinations. In a most typical embodiment, arms 11 are made of aluminum. Arms 11 are attached to bushings on shaft 40. Shaft 40 is attached to bearings 29. Bearings 29 attach to seat 12.

FIG. 5 is a top view of the three dimensional mover once the seat and upper linkages have been removed. The use of reference numerals in FIG. 5 correspond to the same elements with the reference numerals set forth in FIGS. 3 and 4. While the use of springs to apply tension to the cam followers is one method of maintaining pressure on the cam, the preferred method may be the use of a closed track cam system, negating the need for springs. In addition, it is recognized that there are several methods known in the art to achieve three dimensional motion. It is within the scope and spirit of this invention to utilize computer generated programs or alternative methods that provide rotational forces in three dimensions.

Figure 6:
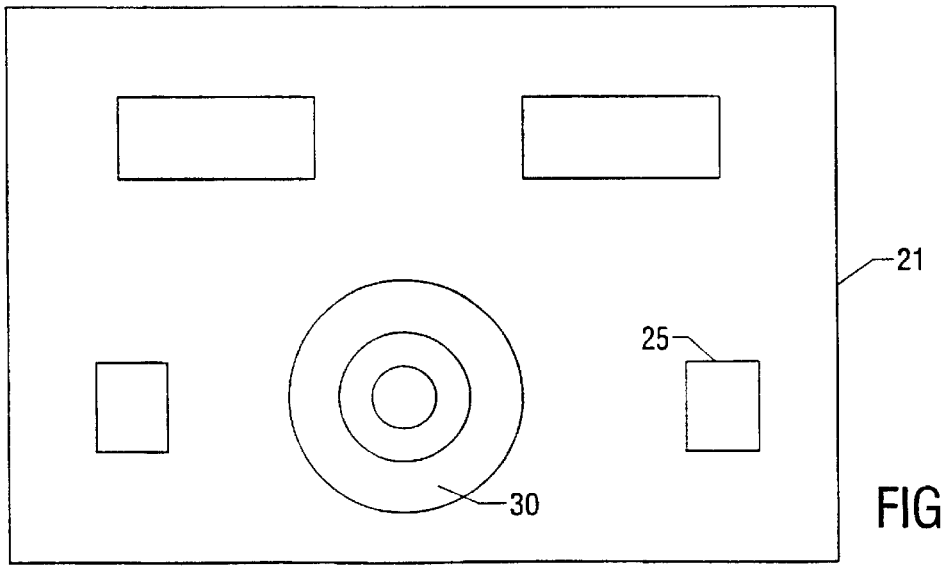
FIG. 6 shows a hand held device for use with a three dimensional mover.

In FIG. 6, there is illustrated a hand held device 21. Hand held device 21 includes safety switch 25 and a varistat 30. Switch 25 lets a caregiver quickly shut off the power to the three dimensional mover. Varistat 30 controls the simulated number of steps per minute of the riding device. As illustrated, varistat 30 allows a caregiver to adjust the number of simulated steps per minute to be preferably between about 60 and about 120 cycles per minute. Currently, this is believed to be the ideal pace for therapeutic benefits to a rider. However, other frequencies are within the scope of the present disclosure. For example, in certain embodiments, the number of simulated steps is between about 40 to about 200 horse steps per minute. It is envisioned that the varistat could be in the range of 20 to 200 cycles per minute or Specifically, varistat 30 may be adjusted to provide for any number of simulated steps per minute.

It is a feature of the present riding device that the six cam system (consisting of two outer, two inner, and two innermost cams) may be completely customized to create any number of three dimensional movement patterns of seat 12. By changing the size, shape, or other configuration of any or all of the cams, one may alter the movement of seat 12. Various degrees of movement in one, two, or three planes can be achieved by altering the cam(s) or utilizing other methods to provide rotational forces and still be within the scope and spirit of this invention. The function of the cams is to simulate all aspects of a horse's motion. Particularly, the triple cam system simulates aspects including, but not limited to: deceleration of a horse's hind limb during swing, a horse's stance when one hind limb is fully extended under its pelvis, alternating steps of a horse's hind limbs, the rotation of a horse's trunk, the shift of a horse's trunk, the tilt of a horse's pelvis in two planes, and push-off and swing-through of a horse's hind limbs during gait.

It is a feature of the three dimensional mover that the cams may be substituted for other cams having different eccentricities or other such attributes. Depending upon how each cam is machined, such an exchange may provide for an increase or decrease in the resulting y-axis displacement, x-axis displacement, or z-axis displacement. It is also recognized that the width of the three dimensional mover will affect the results of rotation about the local z-axis. It is understood that the above described shapes, widths, dimensions, sizes of the cams and members, and location of the axis of rotation of the disclosed device could be altered and still be within the scope and practice of the three dimensional mover. The patient's therapeutic benefit in relation to changes in tilt, displacement, and rotation provided by the three dimensional mover will depend upon the size of the rider's pelvis, as well as the rider's degree of joint motion, muscle tone, flexibility, and motor control.

Figure 7:
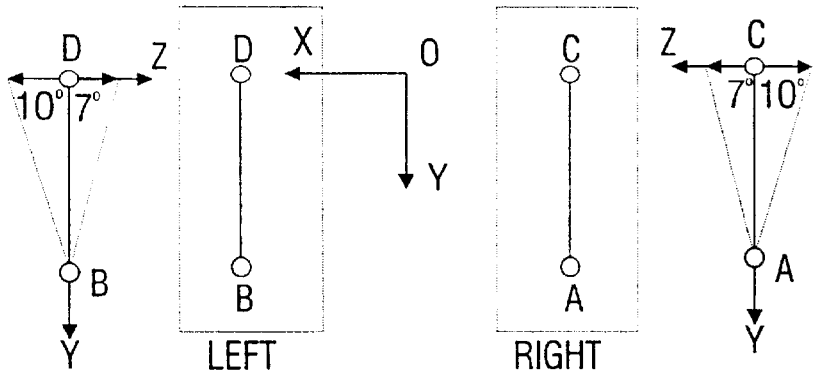
FIGS. 7–15 illustrate rotations about the local x-axis at points A and B (with reference to FIG. 1). The data set forth in FIGS. 8–15 is recorded in terms of rotations about local x-axes at points A and B (clockwise (CW) rotation pertains to posterior tilt of the horse pelvis at A or B; counter clockwise (CCW) rotation pertains to anterior tilt).

FIG. 7 illustrates the rotation about the local x-axis at points A and B causing a displacement of the rider at points C and D, simulating the anterior or posterior tilt of the horse's pelvis.

Figure 8:
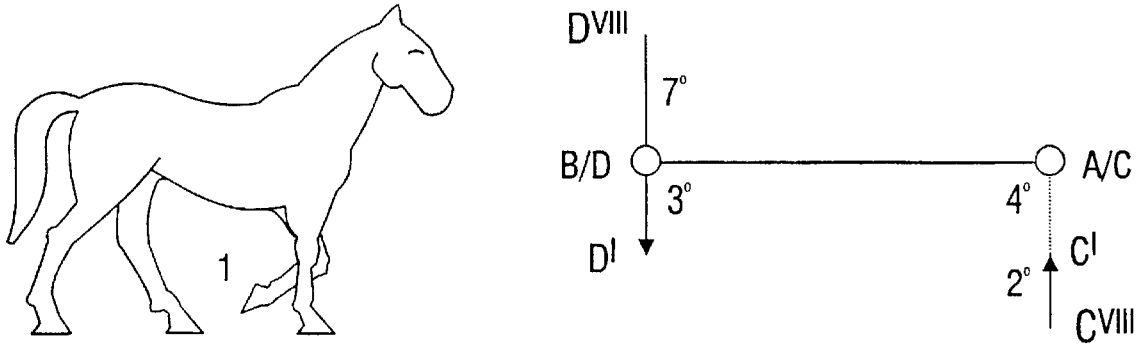

FIG. 8 illustrates the degree of rotation about the local x-axis pertaining to terminal stance of the horse's right hind limb and hoof strike of the left hind limb.

Figure 9:
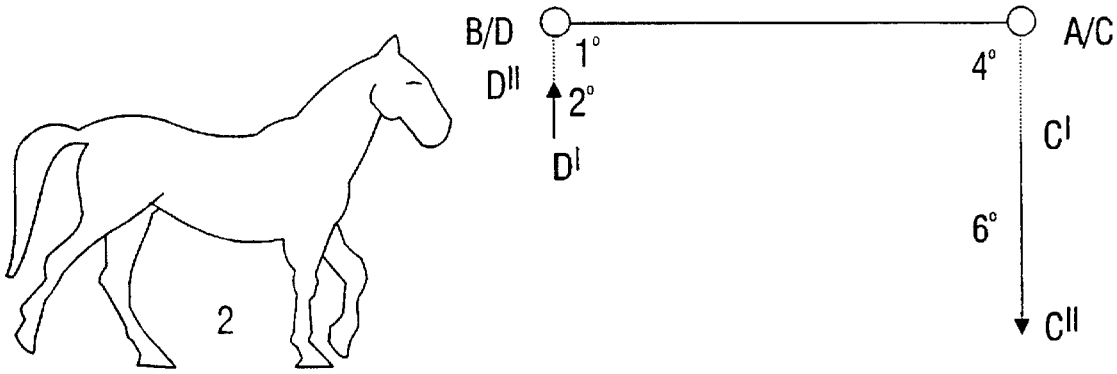

FIG. 9 illustrates the degree of rotation about the local x-axis pertaining to push-off of the horse's right hind limb and initial stance of the left hind limb.

Figure 10:
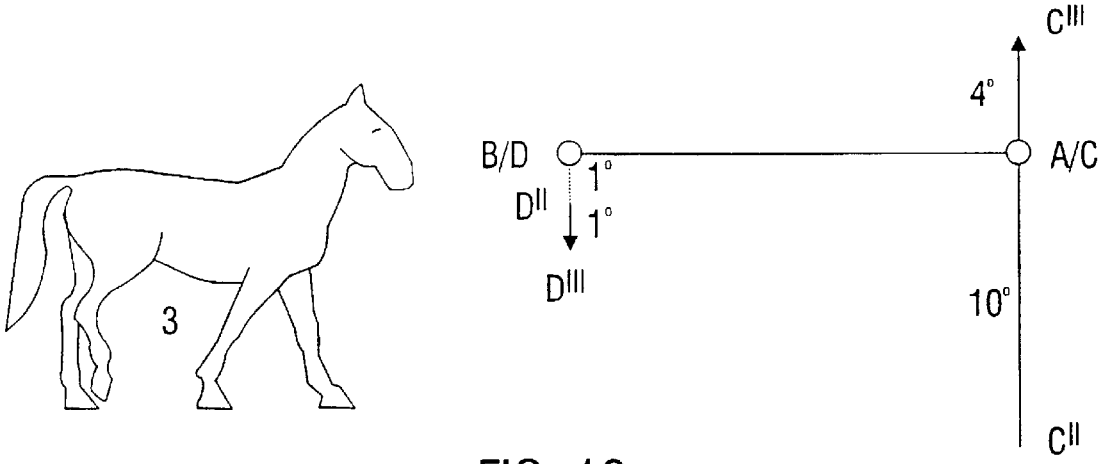

FIG. 10 illustrates the degree of rotation about the local x-axis pertaining to mid-swing of the horse's right hind limb and mid-stance of the left hind limb.

Figure 11:
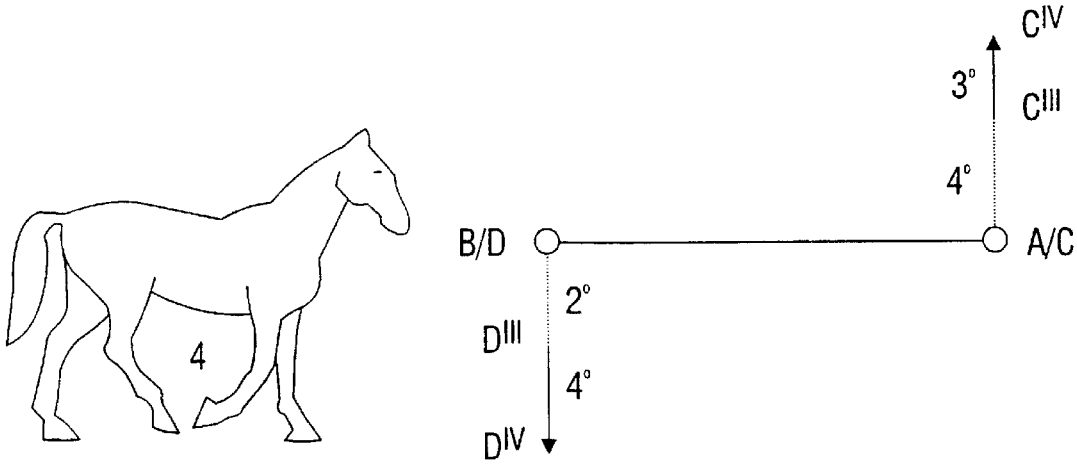

FIG. 11 illustrates the degree of rotation about the local x-axis pertaining to terminal swing of the horse's right hind limb and late stance of the left hind limb.

Figure 12:
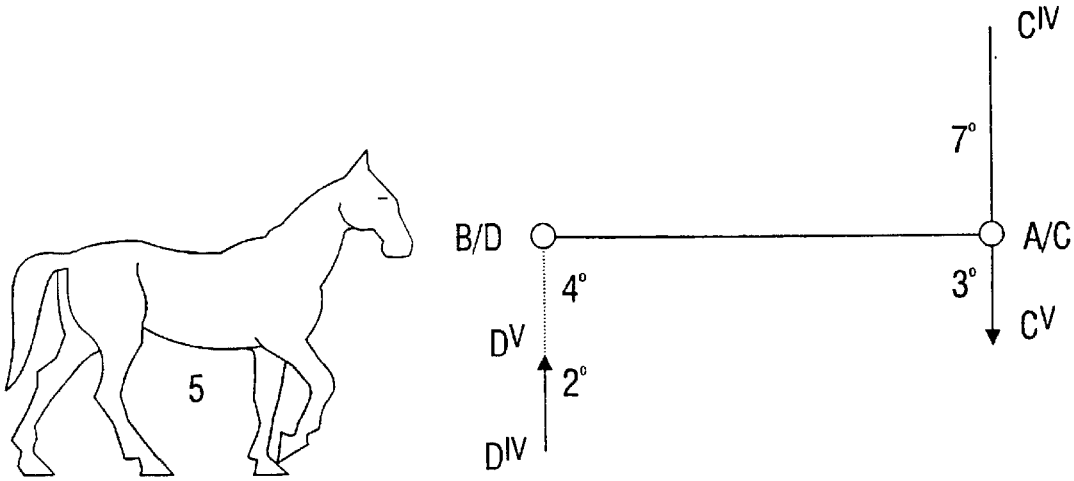

FIG. 12 illustrates the degree of rotation about the local x-axis pertaining to hoof strike of the horse's right hind limb and terminal stance of the horse's left hind limb.

Figure 13:
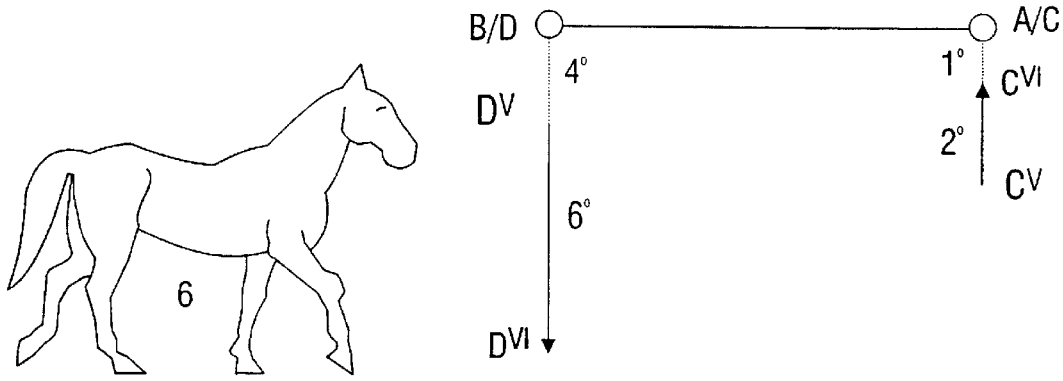

FIG. 13 illustrates the degree of rotation about the local x-axis pertaining to initial stance of the horse's right hind limb and push-off of the horse's left hind limb.

Figure 14:
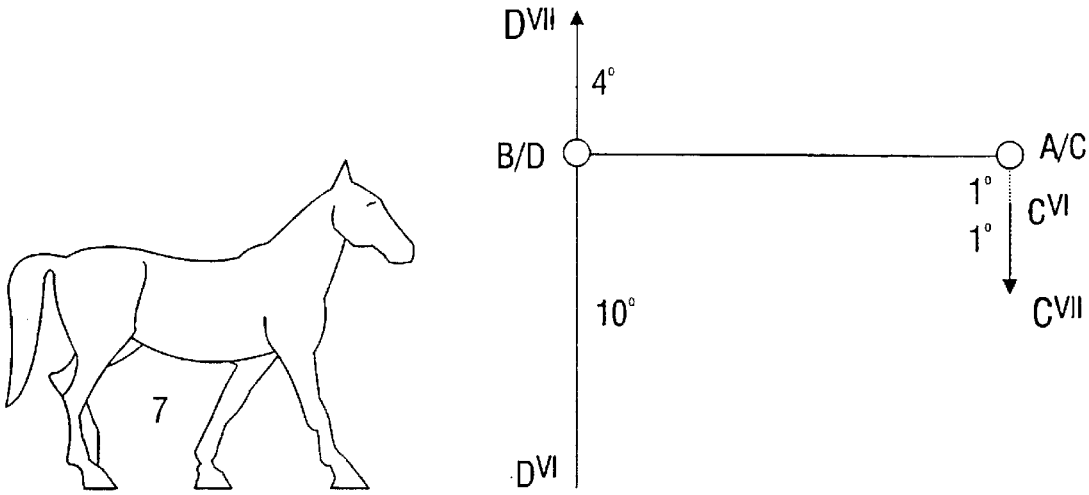

FIG. 14 illustrates the degree of rotation about the local x-axis pertaining to mid-stance of the horse's right hind limb and mid-swing of the hose's left hind limb.

Figure 15:
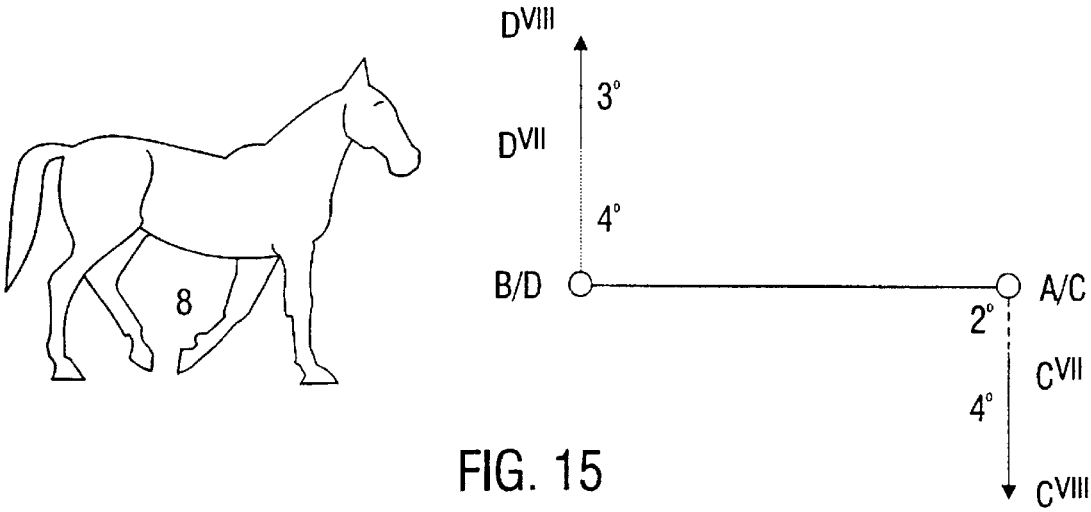

FIG. 15 illustrates the degree of rotation about the local x-axis pertaining to late stance of the horse's right hind limb and terminal swing of the horse's left hind limb.

Figure 16:
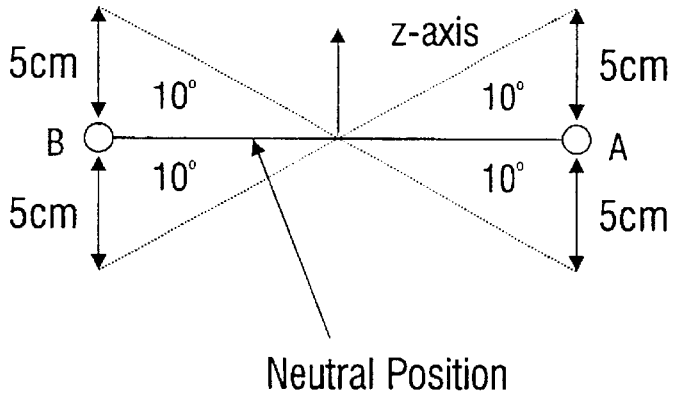
FIGS. 16–24 illustrate rotations about the local x-axis at points A and B (with reference to FIG. 1). Rotation of cams 32*a* and 32*b* is about local x-axis. The data set forth in FIGS. 16–24 is recorded in terms of z-displacements at points A and B.
Figure 17:
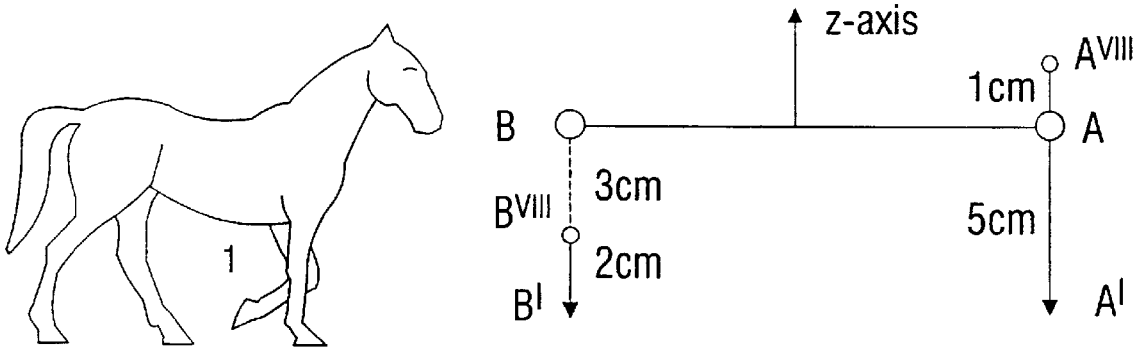

FIG. 16 illustrates the z-displacements of points A and B along the z-axis as a result of rotation of cam 32*a* or 32*b* about the local x-axis FIG. 17 illustrates the z-displacements of points A and B due to rotation of the cams about the local x-axis pertaining to terminal stance of the horse's right hind limb and hoof strike of the left hind limb.

Figure 18:
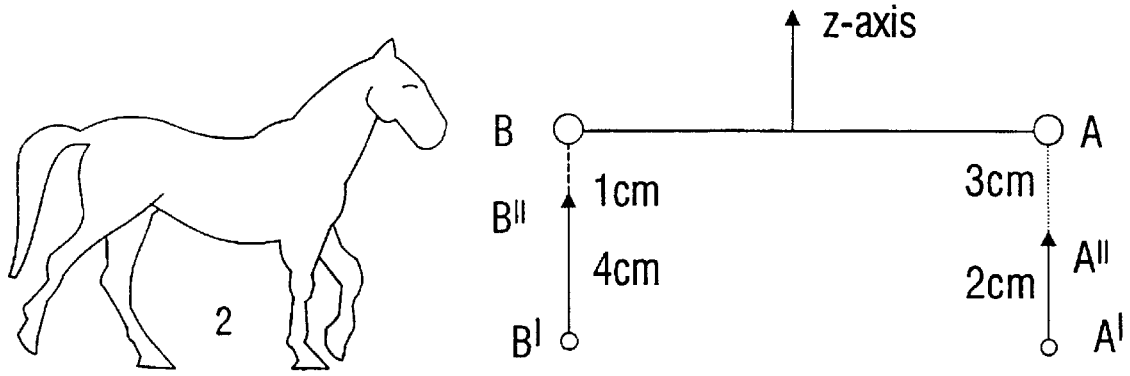

FIG. 18 illustrates the z-displacements of points A and B due to rotation of the cams about the local x-axis pertaining to push-off of the horse's right hind limb and initial stance of the left hind limb.

Figure 19:
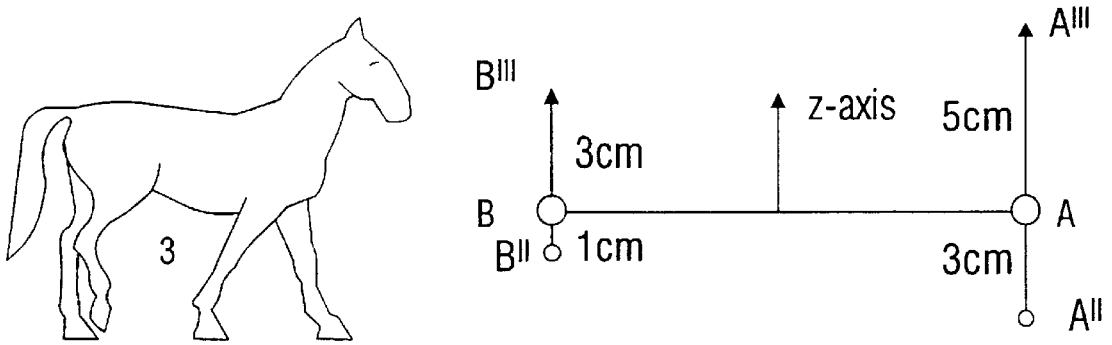

FIG. 19 illustrates the z-displacements of points A and B due to rotation of the cams about the local x-axis pertaining to mid-swing of the horse's right hind limb and mid-stance of the left hind limb.

Figure 20:
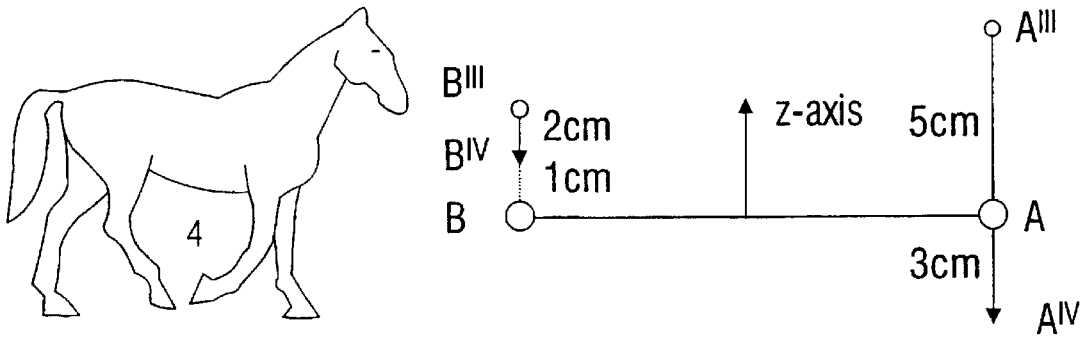

FIG. 20 illustrates the z-displacements of points A and B due to rotation of the cams about the local x-axis pertaining to terminal swing of the horse's right hind limb and late stance of the left hind limb.

Figure 21:
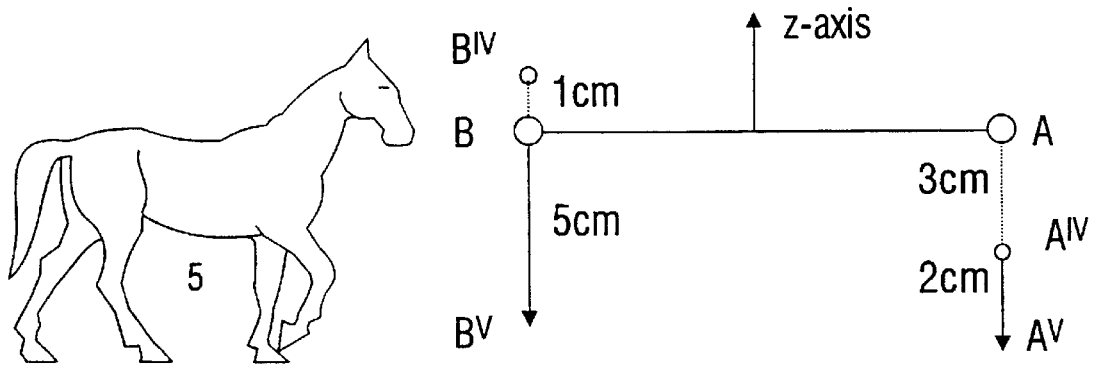

FIG. 21 illustrates the z-displacements of points A and B due to rotation of the cams about the local x-axis pertaining to hoof strike of the horse's right hind limb and terminal stance of the horse's left hind limb.

Figure 22:
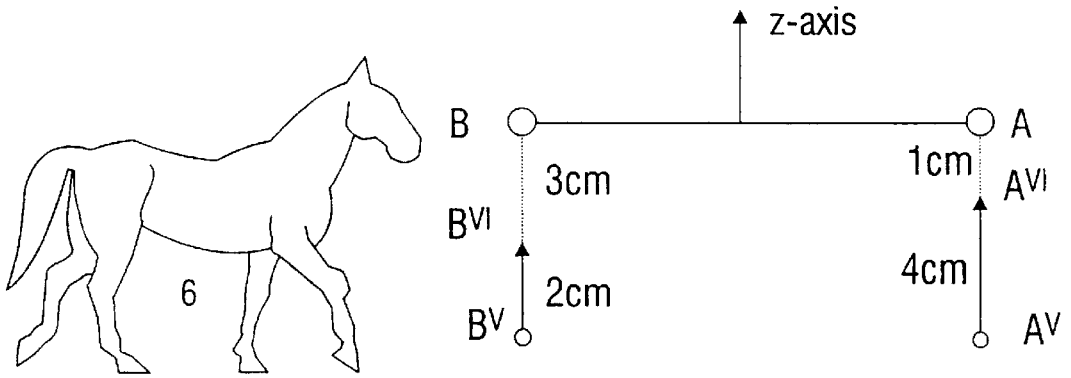

FIG. 22 illustrates the z-displacements of points A and B due to rotation of the cams about the local x-axis pertaining to initial stance of the horse's right hind limb and push-off of the horse's left hind limb.

Figure 23:
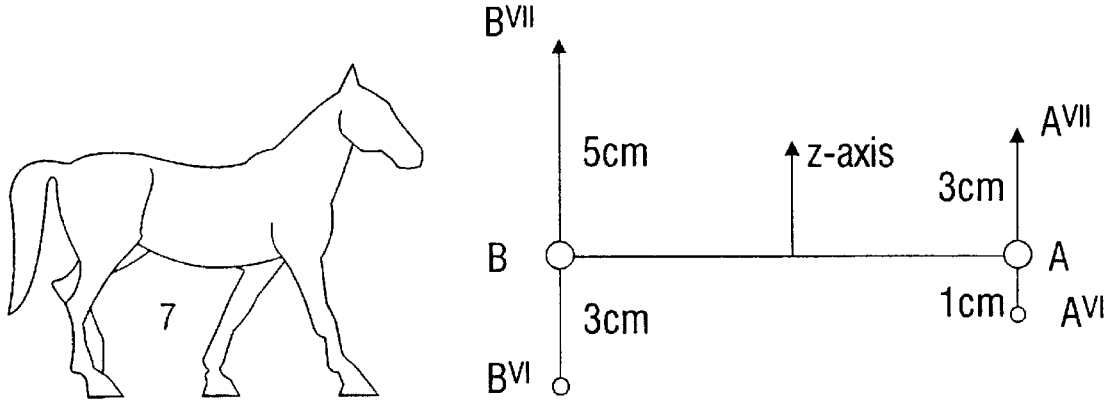

FIG. 23 illustrates the z-displacements of points A and B due to rotation of the cams about the local x-axis pertaining to mid-stance of the horse's right hind limb and mid-swing of the hose's left hind limb.

Figure 24:
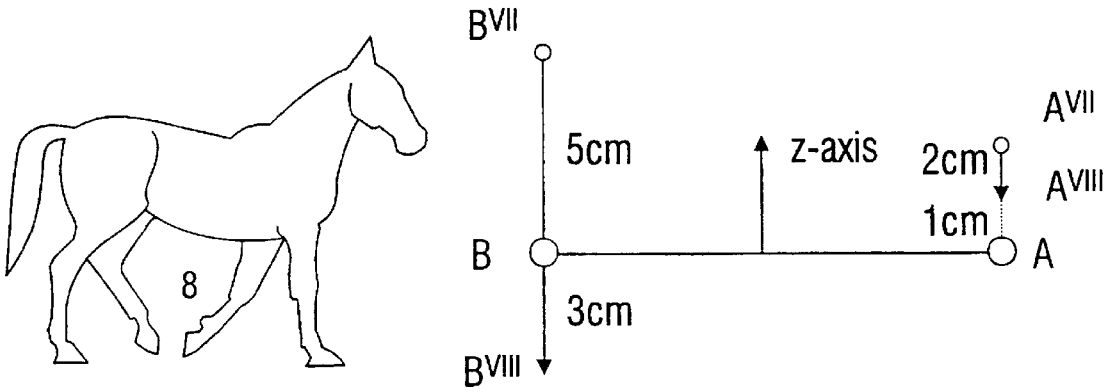

FIG. 24 illustrates the z-displacements of points A and B due to rotation of the cams about the local x-axis pertaining to late stance of the horse's right hind limb and terminal swing of the horse's left hind limb.

Figure 25:
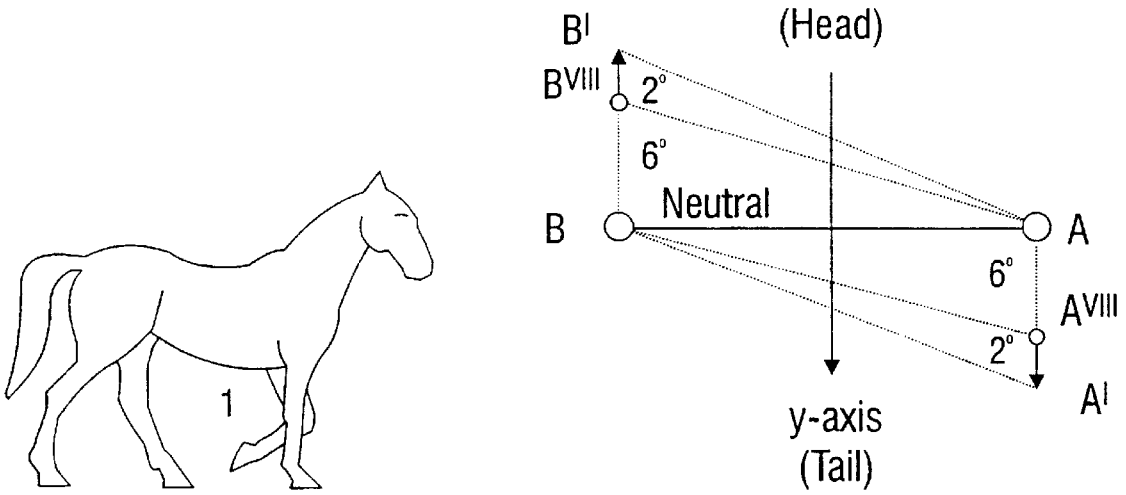
FIGS. 25–32 illustrate rotations about the local z-axis at points A and B (with reference to FIG. 1). The data set forth in FIGS. 25–32 is recorded in terms of rotations about local z-axes at points A and B

FIG. 25 illustrates the degree of rotation about the local z-axis and the implied displacement along the local y-axis pertaining to terminal stance of the horse's right hind limb and hoof strike of the left hind limb. Not illustrated is the corresponding lateral displacement along the local x-axis as a function of the arc of rotation or the degree of lateral pelvic tilt.

Figure 26:
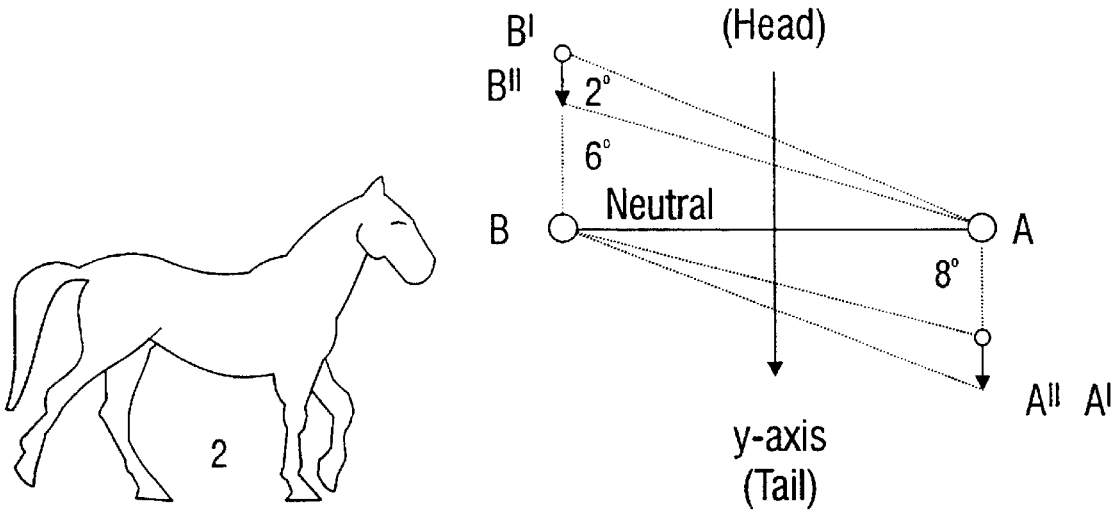

FIG. 26 illustrates the degree of rotation about the local z-axis and the implied displacement along the local y-axis pertaining to push-off of the horse's right hind limb and initial stance of the left hind limb. Not illustrated is the corresponding lateral displacement along the local x-axis as a function of the arc of rotation or the degree of lateral pelvic tilt.

Figure 27:
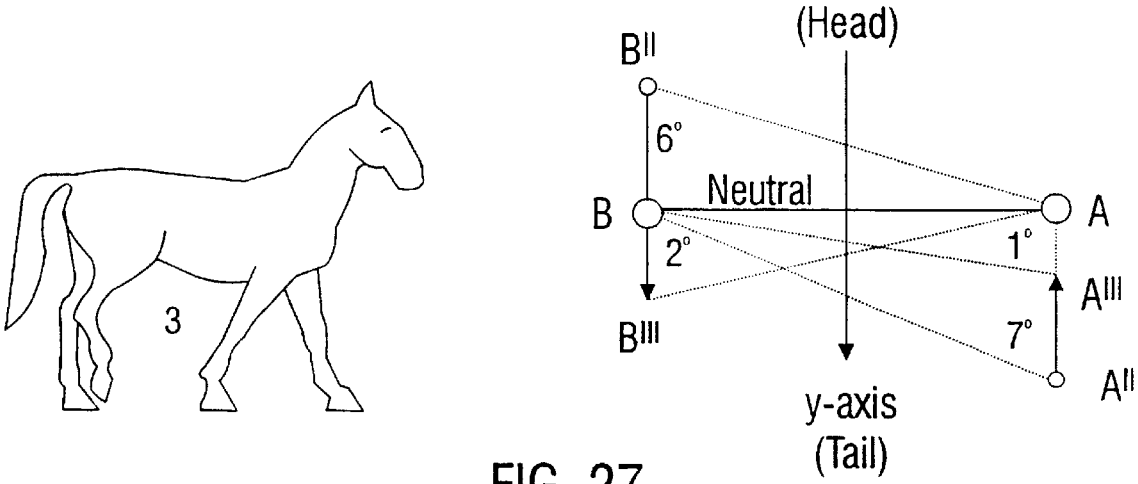

FIG. 27 illustrates the degree of rotation about the local z-axis and the implied displacement along the local y-axis pertaining to mid-swing of the horse's right hind limb and mid-stance of the left hind limb. Not illustrated is the corresponding lateral displacement along the local x-axis as a function of the arc of rotation or the degree of lateral pelvic tilt.

Figure 28:
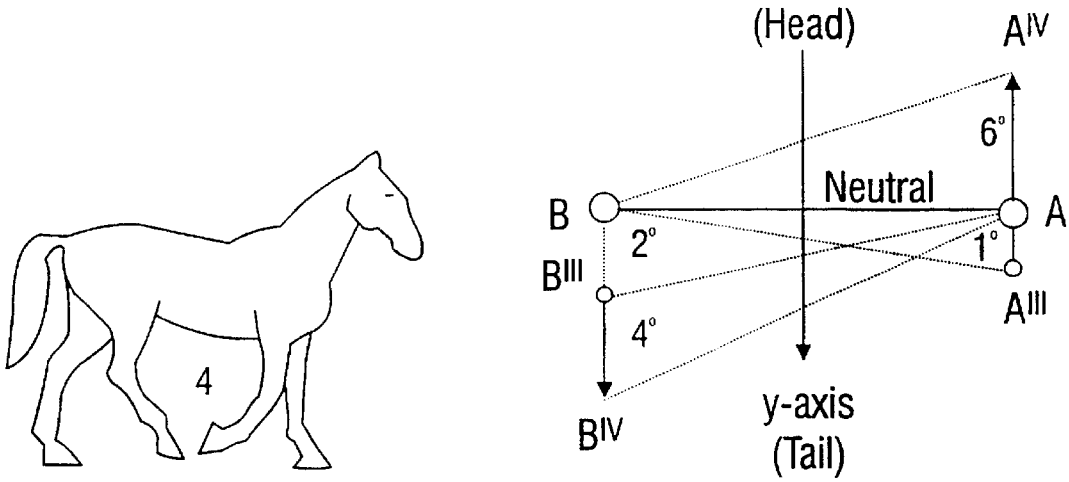

FIG. 28 illustrates the degree of rotation about the local z-axis and the implied displacement along the local v-axis pertaining to terminal swing of the horse's right hind limb and late stance of the left hind limb. Not illustrated is the corresponding lateral displacement along the local x-axis as a function of the arc of rotation or the degree of lateral pelvic tilt.

Figure 29:
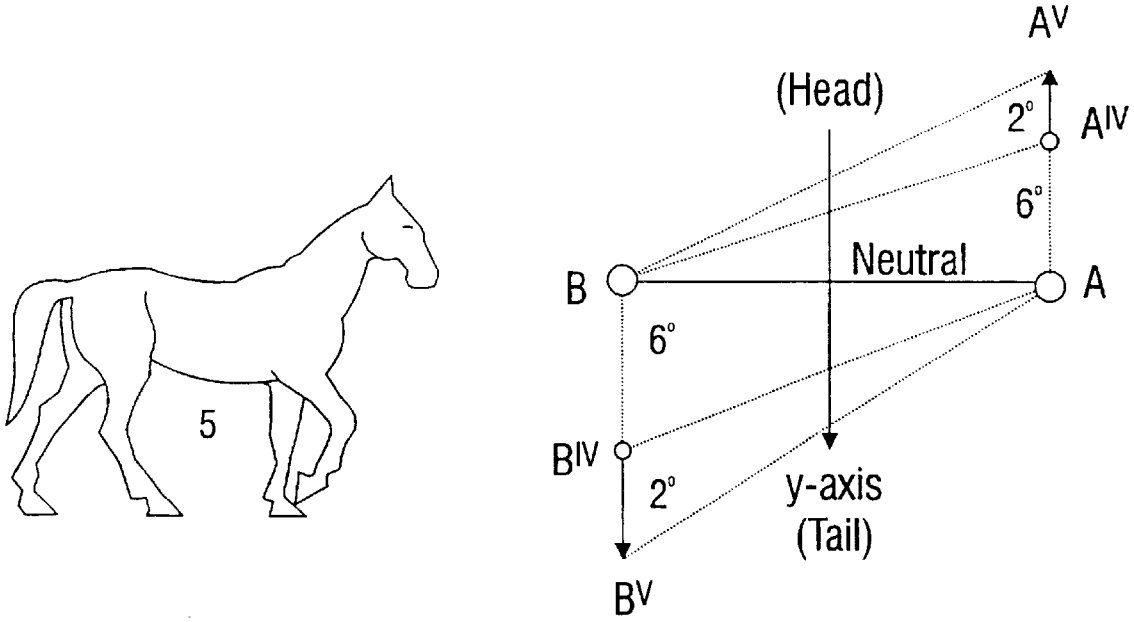

FIG. 29 illustrates the degree of rotation about the local z-axis and the implied displacement along the local v-axis pertaining to hoof strike of the horse's right hind limb and terminal stance of the horse's left hind limb. Not illustrated is the corresponding lateral displacement along the local x-axis as a function of the arc of rotation or the degree of lateral pelvic tilt.

Figure 30:
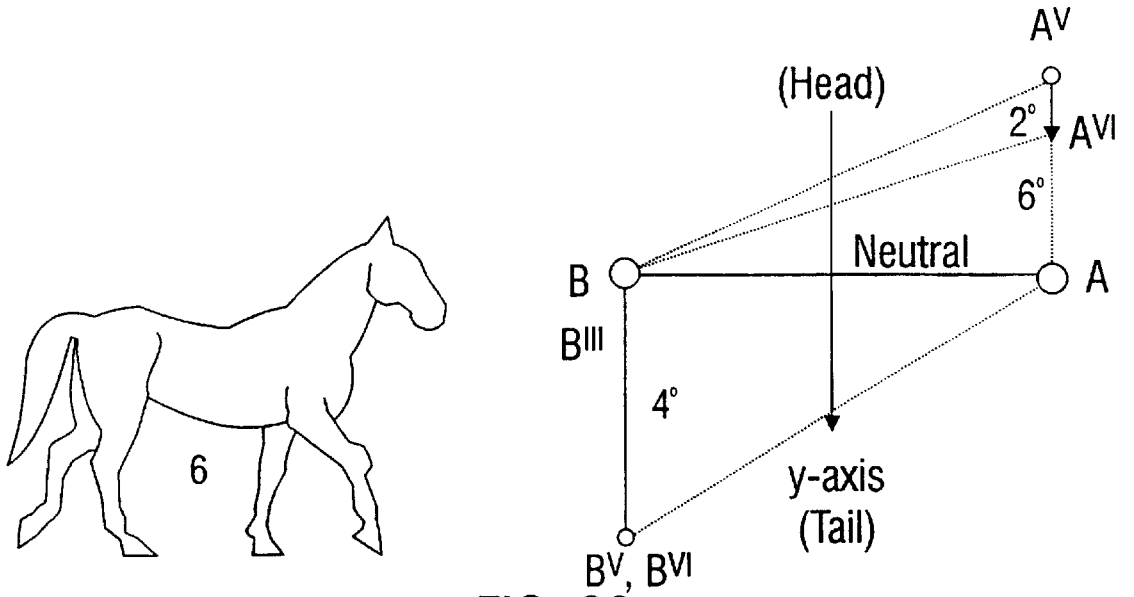

FIG. 30 illustrates the degree of rotation about the local z-axis and the implied displacement along the local y-axis pertaining to initial stance of the horse's right hind limb and push-off of the horse's left hind limb. Not illustrated is the corresponding lateral displacement along the local x-axis as a function of the arc of rotation or the degree of lateral pelvic tilt.

Figure 31:
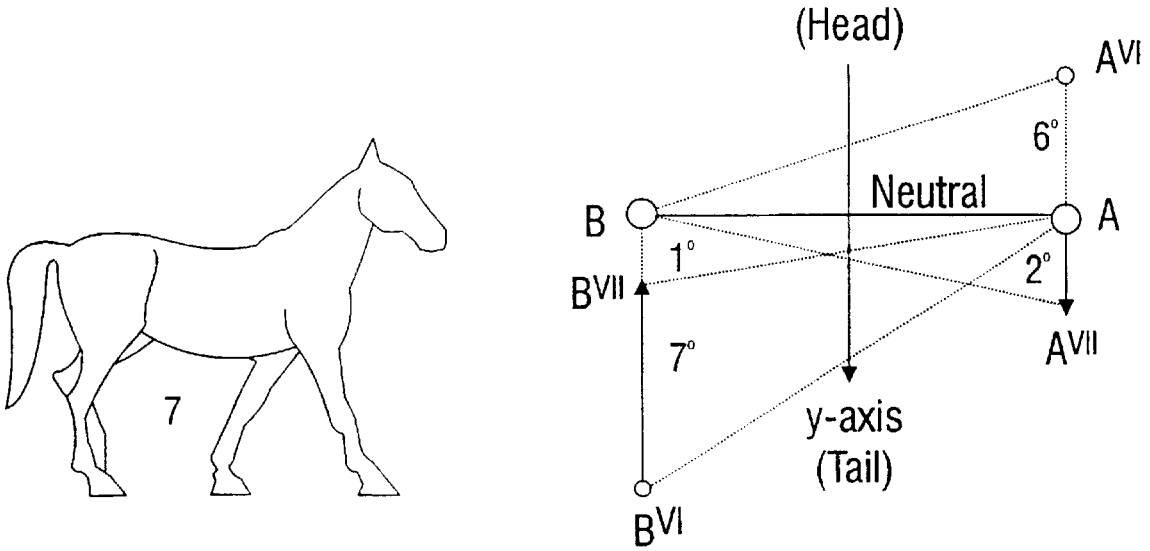

FIG. 31 illustrates the degree of rotation about the local z-axis and the implied displacement along the local y-axis pertaining to mid-stance of the horse's right hind limb and mid-swing of the hose's left hind limb. Not illustrated is the corresponding lateral displacement along the local x-axis as a function of the arc of rotation or the degree of lateral pelvic tilt.

Figure 32:
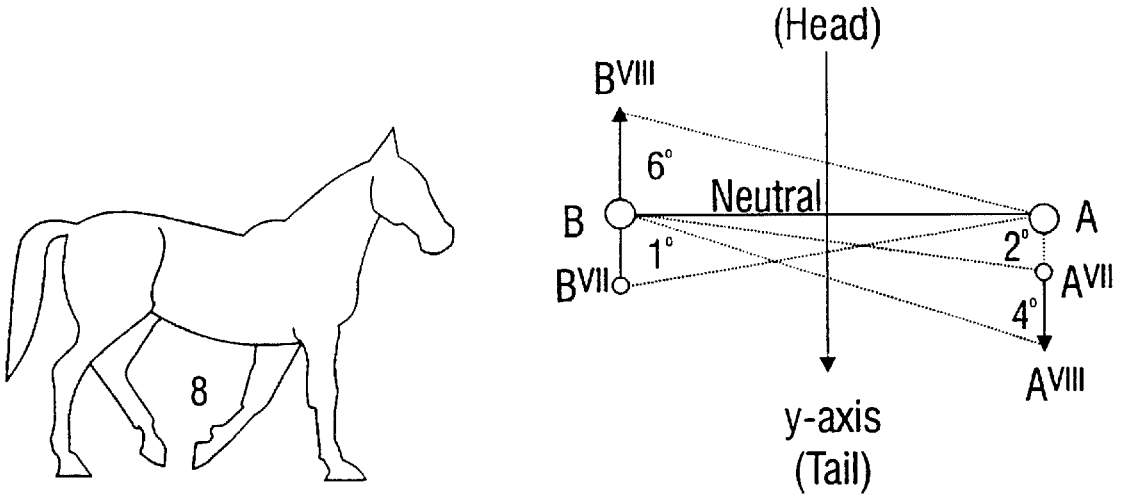

FIG. 32 illustrates the degree of rotation about the local z-axis and the implied displacement along the local y-axis pertaining to late stance of the horse's right hind limb and terminal swing of the horse's left hind limb. Not illustrated is the corresponding lateral displacement along the local x-axis as a function of the arc of rotation or the degree of lateral pelvic tilt.

Figure 33:
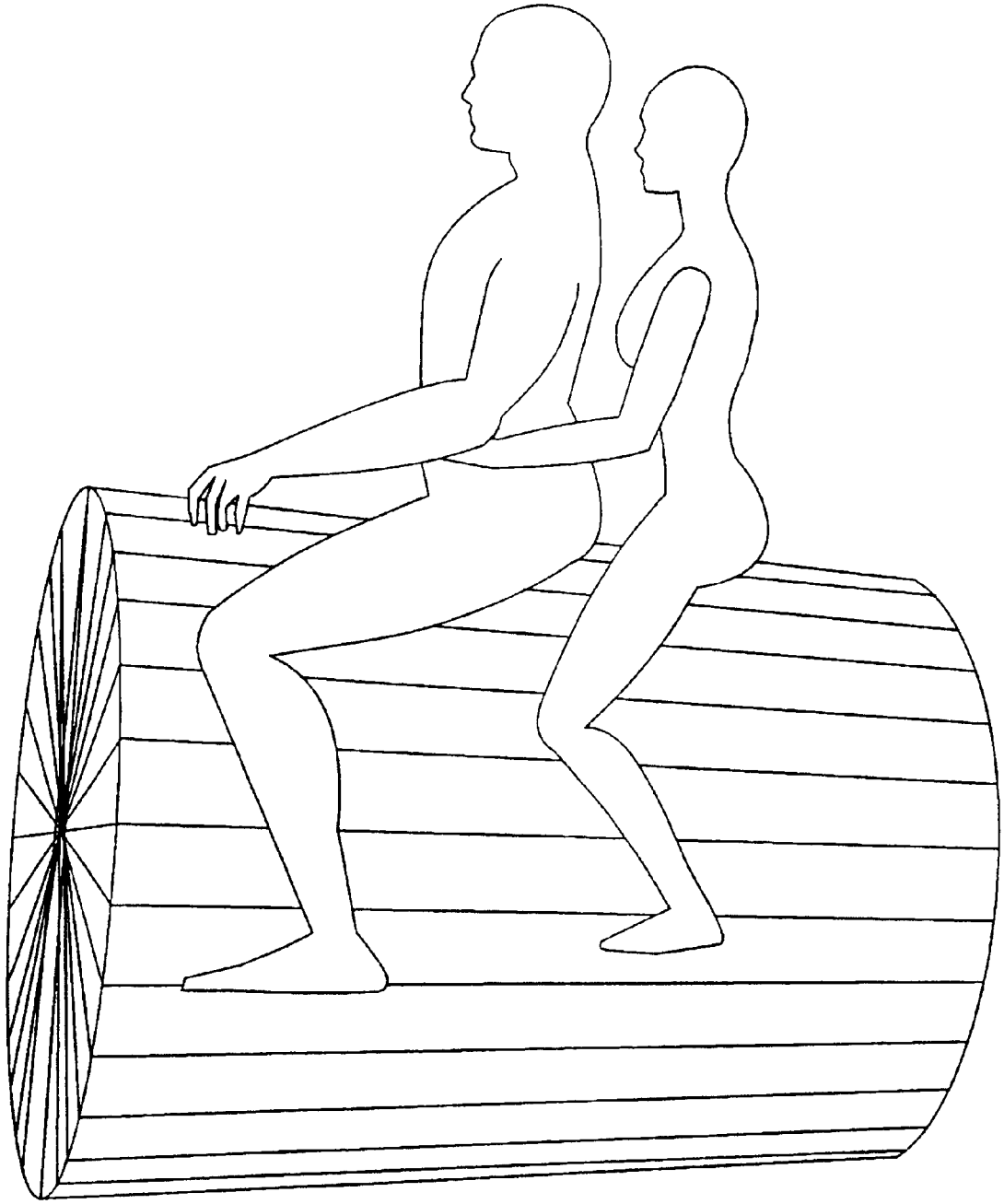
FIG. 33 illustrates the application of the three dimensional mover in accord with the present invention with a tall and heavy adult accompanied by an adult therapist. This application could not be achieved on a horse according to the North American Riding for the Handicapped Association safety guidelines. See FIG. 3 and FIG. 4 for the shape of an exemplary embodiment of the present invention.
Figure 34A:
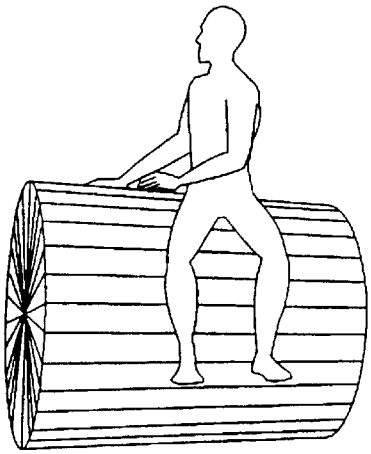
FIG. 34A, FIG. 34B and FIG. 34C illustrate the application of the three dimensional mover in accord with the present invention to strengthen the trunk and pelvic muscles of a patient.
Figure 34B:
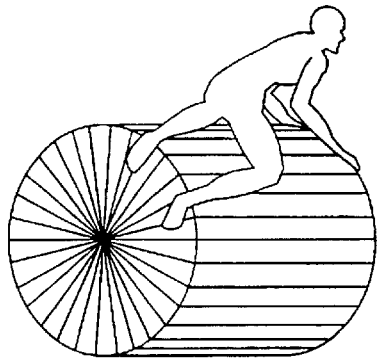
Figure 34C:
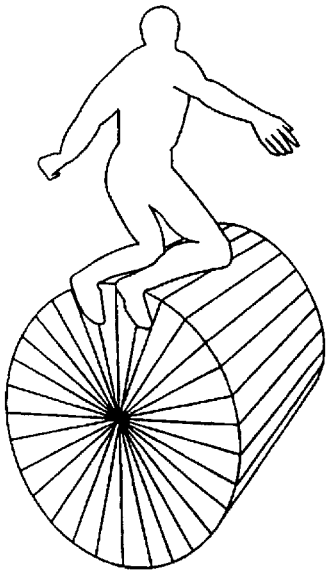
Figure 35A:
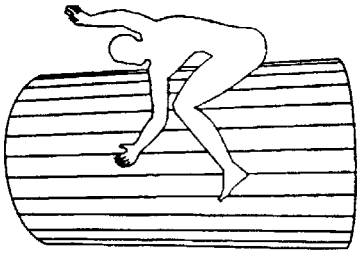
FIG. 35A, FIG. 35B, FIG. 35C, FIG. 35D, FIG. 35E, and FIG. 35F illustrate the application of the three dimensional mover in accord with the present invention in dynamic activities.
Figure 35B:
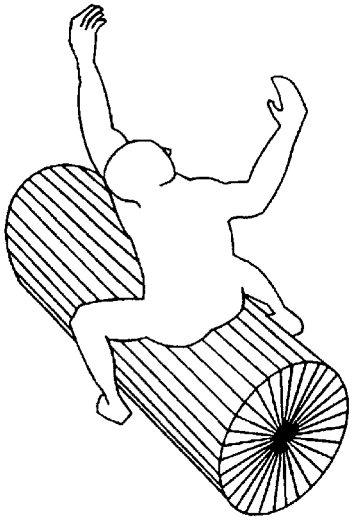
Figure 35C:
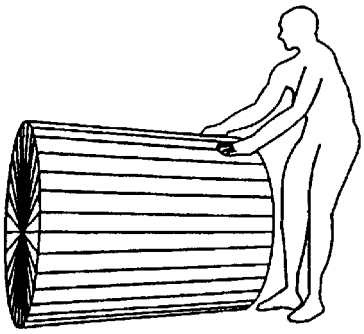
Figure 35D:
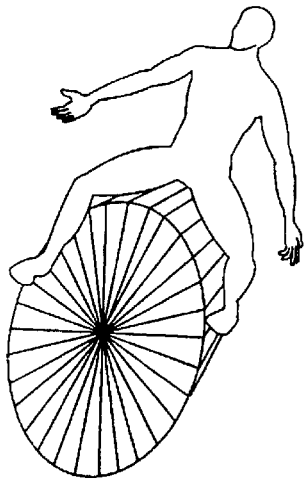
Figure 35E:
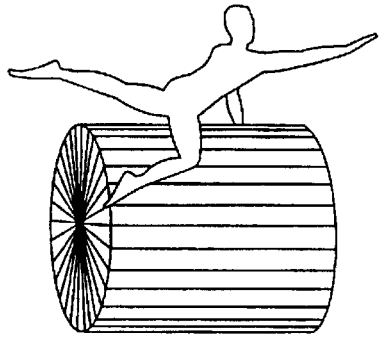
Figure 35F:
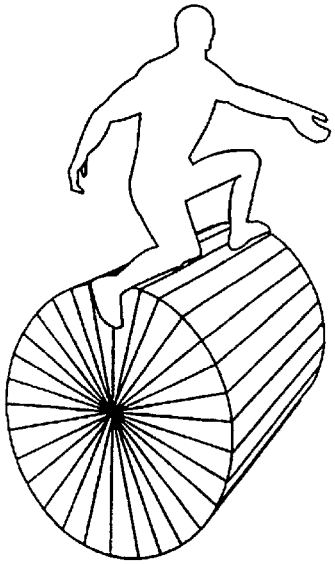

FIG. 33 through FIG. 35 schematically illustrate the three dimensional mover as a cylinder; however the actual design is depicted in FIG. 3 through FIG. 5. FIG. 34 and FIG. 35 indicate use of the three dimensional mover for encouragement of developmental sequences or alternatively for training in vaulting techniques. FIG. 35*e* illustrates the use of the three dimensional mover to provide continuous passive range of motion to the wrists or shoulders. Similarly, the ankle could receive three dimensional passive range of motion if the patient is seated on a stationary platform twice as high as the three dimensional mover in such a way that the patient's foot dangles down to weightbear on the device. Alternatively, the patient could experience passive range of motion to the hips and low back by assuming the hands and knees position (FIG. 34*b*) with the upper extremities weight-bearing on a stationary surface (not illustrated).

It will be appreciated that the therapeutic riding device described above may be used for research of the effectiveness of simulated hippotherapy. Research using the three dimensional mover may be tailored so that only certain parameters are varied. For example, the cam design of the therapeutic device allows researchers to easily change one or more specific aspects of simulated horse motion. Those changes may perhaps then be correlated with physical or behavioral changes of riders.

It will further be appreciated that the hippotherapy simulator described above may be equipped with a saddle and/or stirrups. Utilizing a warming unit on or within surface 70 may simulate bareback riding. The riding device may also be equipped with an overhead support frame. The support frame would be sturdy enough to support a harness for three point partial suspension of the rider. A trunk and pelvis jacket, available in different lengths depending on the need for support could provide the amount of support. The trunk and pelvis jacket would be made of canvas, porous mesh plastic, cloth or other suitable material. The therapist could determine the percent of gravity eliminated through the use of suspension and could be controlled using the tension supplied through support cables leading from the trunk jacket to the overhead support frame. The three dimensional mover may also be equipped with platforms to support various additional equipment, such as ventilator, oxygen tank, intravenous poles, electrocardiogram monitor, electromyography computer, pulse oximeter, oxygen cart for collection of expired air, or any other medical equipment which may serve useful to the rider or researcher. Alternatively, such equipment could be separate from the riding device, but within a distance for comfortable and safe connection to the patient with hoses, lines, leads, wires, tubes, and/or cables.

Finally, it will be appreciated that in constructing a hippotherapy apparatus according to the present disclosure, certain significant advantages are provided. In particular, the disclosed three dimensional mover allows impaired patients to undergo controlled, ideal hippotherapy in a safe, comfortable setting.

The foregoing description has been directed to a particular embodiment in accordance with the requirements of the Patent Statutes for the purposes of illustration and explanation. It will be apparent, however, to those skilled in the art that many modifications and changes in the apparatus set forth will be possible without departing from the scope and spirit of the invention. It is intended that the following claims be interpreted to embrace all such modifications and changes.

What is claimed is:

1. An apparatus for performing hippotherapy, said apparatus comprising:

a seat configured to support a rider;

at least one outer cam coupled to said seat and configured to propel said seat in a first set of directions;

at least one inner cam coupled to said seat and configured to propel said seat in a second set of directions;

at least one innermost cam coupled to said seat and configured to propel said seat in a third set of directions; and a motor coupled to said at least one outer cam and said at least one inner cam and said at least one innermost cam to drive said at least one outer cam and said at least one inner cam and said at least one innermost cam.

2. The apparatus of claim 1, wherein said at least one outer cam is machined differently from said at least one inner cam to create an alternating movement pattern of said seat corresponding to an alternating pattern of a horse's gait.

3. The apparatus of claim 1, wherein said at least one outer, inner, or innermost cam is substituted with another outer, inner, or innermost cam having different attributes to cause a change in a movement pattern of said seat.

4. The apparatus of claim 1, wherein said first set of directions is generally orthogonal to said second set of directions and to said third set of directions.

5. The apparatus of claim 1, where a combination of said first, second and third set of directions produces simulated three dimensional motion of a horse.

6. The apparatus of claim 5, wherein said simulated three dimensional motion comprises about 60 to about 120 simulated horse steps per minute.

7. The apparatus of claim 5, wherein said simulated three dimensional motion causes said rider to experience a cyclic lateral pelvic tilt of approximately 5 to 15 degrees.

8. The apparatus of claim 5, wherein said simulated three dimensional motion causes said rider to experience a cyclic lateral pelvic displacement of approximately 3 centimeters to about 12 centimeters.

9. The apparatus of claim 5, wherein said simulated three dimensional motion causes said rider to experience a cyclic anterior or posterior tilt of about 3 degrees to about 10 degrees.

10. The apparatus of claim 5, wherein said simulated three dimensional motion causes said rider to experience a cyclic pelvic rotation of about 3 degrees to about 15 degrees.

11. An apparatus for hippotherapy, comprising:

a seat configured to support a rider;

a support frame coupled to said seat, said support frame for housing mechanical components for movement of said seat;

said mechanical components comprising:

a first pair of cams coupled to said seat for movement of said seat along a first axis, said first pair of cams being spaced apart by a first distance;

a second pair of cams coupled to said seat for movement of said seat along a second axis, said second pair of cams being spaced apart by a second distance, said second distance being greater than said first distance;

a third pair of cams coupled to said seat for movement of said seat along a third axis, said third pair of cams being spaced apart by a third distance, said third distance being greater than said second distance;

said first, second, and third pairs of cams for moving said seat in three dimensions; and a motor operatively coupled to provide motive power to said first, second, and third pairs of cams.

12. The apparatus of claim 11, wherein said apparatus simulates three dimensional movement of a horse without associated simulated legs of said horse.

13. The apparatus of claim 11, further comprising a tilt mechanism coupled to said support frame for inclining said seat.

14. The apparatus of claim 11, further comprising a safety switch to stop operation of said apparatus.

15. The apparatus of claim 11, further comprising a timing belt coupled to said motor, said timing belt adapted to provide rotatable movement to a shaft, said shaft mechanically coupled to said first, second, and third pairs of cams.

16. The apparatus of claim 15, further comprising a pair of cam followers, each one of said pair of cam followers being adjacent one of said first pair of cams, each of said pair of cam followers being tensioned by a spring, said spring being coupled to a linkage, said linkage being coupled to said seat.

17. The apparatus of claim 11, wherein each of said first, second, and third pairs of cams comprise different eccentricities.

18. The apparatus of claim 11, wherein said seat comprises a first and second surface, said first and second surfaces permitting independent three dimensional movement of a first portion and a second portion of said seat.

19. The apparatus of claim 18, further comprising an exchangeable platform for accommodating said rider on said seat.

20. The apparatus of claim 19 wherein said exchangeable platform comprises a heated surface.

21. A method for performing hippotherapy without use of a horse, comprising:

providing an apparatus capable of three dimensional movement, said apparatus having a seat configured to support a patient; a support frame coupled to said seat, said support frame including mechanical components for movement of said seat; said mechanical components comprising a motor, a plurality of cams coupled to said seat to provide said three dimensional movement;

positioning said patient on said seat; and applying operating power to said motor to drive said seat in said three dimensional movement, thereby providing said hippotherapy to said patient without use of said horse.

22. The method of claim 21, further comprising activating a safety switch to stop operation of said apparatus.

23. The method of claim 21, wherein said seat comprises a first and second surface, said first and second surfaces permitting independent three dimensional movement of a first portion and a second portion of said seat.

24. The method of claim 21, further comprising positioning a therapist on said seat and behind said patient.

25. The method of claim 21, wherein said three dimensional movement comprises about 60 to about 120 simulated horse steps per minute.

26. The method of claim 21, wherein said three dimensional movement causes said patient to experience a cyclic lateral pelvic tilt of approximately 5 to 15 degrees.

27. The method of claim 21, wherein said three dimensional movement causes said patient to experience a cyclic lateral pelvic displacement of approximately 3 centimeters to about 12 centimeters.

28. The method of claim 21, wherein said three dimensional movement causes said patient to experience a cyclic anterior or posterior tilt of about 3 degrees to about 10 degrees.

29. The method of claim 21, wherein said three dimensional movement causes said patient to experience a cyclic pelvic rotation of about 3 degrees to about 15 degrees.

30. The method of claim 21, wherein said cams further comprise a first pair of cams coupled to said seat for movement of said seat along a first axis, said first pair of cams being spaced apart by a first distance; a second pair of cams coupled to said seat for movement of said seat along a second axis, said second pair of cams being spaced apart by a second distance, said second distance being greater than said first distance; a third pair of cams coupled to said seat for movement of said seat along a third axis, said third pair of cams being spaced apart by a third distance, said third distance being greater than said second distance; said motor being operatively coupled to said first, second, and third pair of cams.

* * * * *